US009188902B2

(12) United States Patent
Yamazaki

(10) Patent No.: US 9,188,902 B2
(45) Date of Patent: Nov. 17, 2015

(54) IMAGE FORMING APPARATUS AND CORRECTION DATA GENERATION METHOD

(71) Applicant: CANON KABUSHIKI KAISHA, Tokyo (JP)

(72) Inventor: Katsuyuki Yamazaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/660,778

(22) Filed: Mar. 17, 2015

(65) Prior Publication Data

US 2015/0268581 A1 Sep. 24, 2015

(30) Foreign Application Priority Data

Mar. 19, 2014 (JP) ..... 2014-056228

(51) Int. Cl.
*B41J 2/435* (2006.01)
*B41J 2/385* (2006.01)
*G03G 15/043* (2006.01)

(52) U.S. Cl.
CPC ..... *G03G 15/043* (2013.01)

(58) Field of Classification Search
CPC ..... G03G 15/043
USPC ..... 347/118, 236, 246; 399/49, 50
See application file for complete search history.

(56) References Cited

U.S. PATENT DOCUMENTS

| | | | | |
|---|---|---|---|---|
| 7,260,336 | B2 * | 8/2007 | Shimura et al. | 399/49 |
| 7,751,737 | B2 * | 7/2010 | Ishida et al. | 399/50 |
| 8,922,613 | B2 * | 12/2014 | Akagi | 347/236 |
| 2011/0221847 | A1 * | 9/2011 | Takezawa | 347/118 |
| 2013/0286134 | A1 * | 10/2013 | Yamazaki | 347/118 |

FOREIGN PATENT DOCUMENTS

JP 2004-223716 A 8/2004

* cited by examiner

*Primary Examiner* — Julian Huffman
*Assistant Examiner* — Carlos A Martinez
(74) *Attorney, Agent, or Firm* — Canon USA, Inc., IP Division

(57) ABSTRACT

There is provided an image forming apparatus that reduces an operation speed of a unit configured to generate pieces of correction data with which the light intensity of laser light is corrected. Pieces of first correction data in a scanning direction of a photoconductor drum are associated with light sources and stored in memories. For a plurality of regions of the surface of the photoconductor drum, a CPU outputs, for each of the regions, pieces of correction data including pieces of second correction data for correction of electric potential characteristics of the region. The positions of pieces of first correction data match some of the positions of pieces of second correction data. A laser driver IC controls light intensity of laser light at the timing of the pieces of second correction data in accordance with a piece of first correction data and a piece of second correction data.

12 Claims, 18 Drawing Sheets

IMAGE FORMING APPARATUS AND CORRECTION DATA GENERATION METHOD

BACKGROUND OF THE INVENTION

1. Field of the Invention

The present inventions relate to at least one image forming apparatus that forms an image by scanning a photoconductor with a light beam and at least one correction data generation method.

2. Description of the Related Art

In general, an image forming apparatus is known that performs image formation by developing, using toner, an electrostatic latent image formed by scanning a photoconductor with laser light and transferring a toner image formed on the photoconductor to a transfer material. The image forming apparatus corrects (performs shading on) the light intensity of laser light in accordance with an exposure position on the photoconductor. The reason this is performed is to correct nonuniformity in characteristics of sensitivity at a plurality of positions corresponding to laser light on the photoconductor and nonuniformity in light intensity of laser light guided onto the photoconductor by optical characteristics of an optical member such as a lens or a mirror, which guides laser light onto a photoconductor, in a main scanning direction. A main scanning direction is a direction in which laser light scans a photoconductor.

Previously, in correction of light intensity in a main scanning direction, the light intensity of laser light is changed from exposure position to exposure position on a photoconductor in the main scanning direction using a generation time of a BD signal as a reference. In contrast, in correction of light intensity in a rotation direction of the photoconductor (a sub-scanning direction), an exposure position of laser light is determined on the photoconductor in the sub-scanning direction from a photoconductor home position and laser light is changed so as to have a light intensity corresponding to a determination result. An exposure position in the main scanning direction is determined by counting a clock signal output from an oscillator using a BD signal as a reference (for example, see Japanese Patent Application Laid-Open No. 2004-223716).

FIG. 16 illustrates a correction profile 1601, a correction profile 1602, and a correction profile 1603. The correction profile 1601 is a correction profile for correcting nonuniformity in characteristics of sensitivity of a photoconductor. The correction profile 1602 is a correction profile for correcting nonuniformity in light intensity of laser light in the main scanning direction, the laser light having been guided onto the photoconductor by optical characteristics of an optical member. The correction profile 1603 is a correction profile obtained by multiplying the correction profile 1601 by the correction profile 1602. The horizontal axis of FIG. 16 represents a scan position of laser light in the main scanning direction in millimeters, and the vertical axis of FIG. 16 represents a correction amount of the light intensity of laser light in the case where it is assumed that the light intensity of laser light on the photoconductor when the light intensity of laser light is not corrected corresponds to 100%.

For correction of characteristics of sensitivity of the photoconductor, for example, laser-light light intensity correction is needed with a spatial frequency having a period of about 12 mm as a distance on the surface of the photoconductor and with a high resolution greater than or equal to 8 bits (256 levels of gray). In contrast, for correction of optical characteristics of the optical member, for example, light intensity correction is needed with a spatial frequency having a period of about 26 mm as a distance on the surface of the photoconductor and with a high resolution greater than or equal to 8 bits (256 levels of gray).

For pieces of correction data for characteristics of sensitivity and pieces of correction data for optical characteristics of the optical member, pieces of data at positions of plots illustrated in FIG. 16 are stored in a memory unit and pieces of data at positions each of which is between plots are generated by linear interpolation computation. A piece of correction data is read from the memory unit in accordance with an exposure position of laser light, and a piece of light-intensity correction data for laser light is generated by computation in accordance with the read piece of data. That is, previously, a piece of correction data for characteristics of sensitivity of the photoconductor has been read at a period of 12 mm as a spatial frequency, and a piece of correction data for optical characteristics of the optical member has been read at a period of 26 mm as a spatial frequency.

In the case where one main scanning period of laser light is 10 kHz, the scan speed of laser light on the photoconductor is 1000 mm/second. Light intensity correction for laser light in the main scanning direction is performed by converting the correction profile 1603 into an analog signal by a DA converter inside a laser driver and then correcting a driving current to be supplied to a semiconductor laser using the analog signal obtained as a result of the conversion.

However, in the case where a read period of a piece of correction data for characteristics of sensitivity of the photoconductor differs from a read period of a piece of correction data for optical characteristics of the optical member, the relative read timing for pieces of correction data becomes nonperiodic in a one-scan-line period. In the case where relative read timings for pieces of correction data become nonperiodic, there may be the case where the relative read timing for pieces of correction data becomes fast and there may be the case where an electric current correction operation for a correction amount is necessary many times for a short period of time.

For example, an electric current value at a position of 11 mm is a value obtained when the light intensity of laser light corresponds to 88.5% in the main scanning direction in FIG. 16; however, the electric current value needs to be immediately changed to a value obtained when the light intensity of laser light corresponds to 87.5% at a position of 12 mm. In such a case, switching to pieces of correction data for optical characteristics of the optical member to be used for computation needs to be performed since a piece of correction data for optical characteristics of the optical member is read immediately after a piece of correction data for characteristics of sensitivity of the photoconductor is read. An image forming apparatus needs to include a circuit the operation speed of which is fast, in order to do these processes.

For such a high-speed and high-accuracy digital computation circuit operation and an analog operation, a differential circuit or the like needs to be driven at high power and thus heat generated by a driving circuit increases. Thus, there is an issue in that a driving circuit becomes large because of a heat-dissipating component, a power-source stabilizing circuit, and the like and the manufacturing cost is increased because of a large scale of the driving circuit.

The present inventions provide at least one image forming apparatus that reduces an operation speed of a unit that generates pieces of correction data with which the light intensity of laser light is corrected.

SUMMARY OF THE INVENTION

The present inventions provide at least one image forming apparatus, the at least one image forming apparatus including a light source configured to emit a light beam, a photoconductor configured to be exposed to the light beam emitted from the light source, a deflection unit configured to deflect the light beam such that the light beam scans the photoconductor, and an optical member configured to guide the light beam deflected by the deflection unit to the photoconductor, the at least one image forming apparatus developing, using toner, an electrostatic latent image formed on the photoconductor by exposure to the light beam, the at least one image forming apparatus including a storage unit configured to store a plurality of pieces of first correction data and a plurality of pieces of second correction data, the plurality of pieces of first correction data being pieces of data for correcting nonuniformity in density of a toner image, the nonuniformity being caused by electric potential characteristics of the photoconductor with respect to a light beam in a scanning direction in which the light beam scans the photoconductor, the plurality of pieces of first correction data being pieces of data corresponding to respective scan positions of the light beam in the scanning direction, the plurality of pieces of second correction data being pieces of data for correcting a change in light intensity of the light beam guided onto the photoconductor, the change being caused by optical characteristics of the optical member in the scanning direction, the plurality of pieces of second correction data also being pieces of data corresponding to the respective scan positions of the light beam in the scanning direction, and a control unit configured to control, in accordance with a piece of first correction data among the plurality of pieces of first correction data and a piece of second correction data among the plurality of pieces of second correction data output from the storage unit, light intensity of the light beam corresponding to a scan position of the light beam in the scanning direction. In the at least one image forming apparatus, in a period in which the light beam scans once across the photoconductor, timing of a piece of first correction data output by the storage unit from the plurality of pieces of first correction data matches, at least once, timing of a piece of second correction data output by the storage unit from the plurality of pieces of second correction data, and a period in which the storage unit outputs a piece of first correction data from the plurality of pieces of first correction data and a period in which the storage unit outputs a piece of second correction data from the plurality of pieces of second correction data have an integral multiple relationship.

In addition, the present inventions provide at least one correction data generation method for controlling light intensity of a light beam in an image forming apparatus in which the light beam is deflected by a deflection unit of the image forming apparatus such that the light beam, which is emitted from a light source of the image forming apparatus, scans a photoconductor of the image forming apparatus and the light beam deflected by the deflection unit is guided onto the photoconductor by an optical member of the image forming apparatus, the at least one correction data generation method including first outputting, by a storage unit of the image forming apparatus in accordance with a plurality of scan positions of the light beam, a plurality of pieces of first correction data for correcting nonuniformity in density of a toner image, the nonuniformity being caused by electric potential characteristics of the photoconductor with respect to a light beam in a scanning direction in which the light beam scans the photoconductor, the plurality of pieces of first correction data being pieces of data corresponding to the respective scan positions of the light beam in the scanning direction, second outputting, in accordance with the plurality of scan positions of the light beam, a plurality of pieces of second correction data for correcting a change in light intensity of the light beam guided onto the photoconductor, the change being caused by optical characteristics of the optical member in the scanning direction, the plurality of pieces of second correction data being pieces of data corresponding to the respective scan positions of the light beam in the scanning direction, and generating pieces of third correction data corresponding to the plurality of scan positions in accordance with the plurality of pieces of first correction data output in the first outputting step and the plurality of pieces of second correction data output in the second outputting step, the generating step being executed by a control unit of the image forming apparatus. In the at least one correction data generation method, in a period in which the light beam scans once across the photoconductor, timing of the first outputting step executed by the storage unit matches, at least once, timing of the second outputting step executed by the storage unit, and a period in which the first outputting step is executed by the storage unit and a period in which the second outputting step is executed by the storage unit have an integral multiple relationship.

According to other aspects of the present inventions, other apparatuses and methods are discussed herein. Further features of the present inventions will become apparent from the following description of exemplary embodiments with reference to the attached drawings.

BRIEF DESCRIPTION OF THE DRAWINGS

FIG. 6A is a perspective view seen from a lens-barrel side and FIG. 6B is a perspective view seen from a circuit-board side.

FIG. 8A is a diagram illustrating an example of a first profile corresponding to the optical nonuniformity of a certain laser and an example of a second profile corresponding to the optical nonuniformity of another certain laser, and FIG. 8B is a diagram illustrating an example of a third profile corresponding to the nonuniformity in a two-dimensional region of one photoconductor drum. FIG. 8C is a diagram illustrating an example of a fourth profile corresponding to nonuniformity in the optical face tangle error of a rotating polygon mirror, and FIG. 8D is a diagram illustrating an example of a correction profile in which the third and fourth profiles are superimposed.

FIG. 11A is a diagram illustrating a drum counter clock, which is a drum sub-scanning periodic signal, FIG. 11B is a diagram illustrating a drum counter clock, which is a drum main-scanning periodic signal, and FIG. 11C is a diagram illustrating a polygon-face counter clock, which is a periodic signal regarding polygon rotation.

DESCRIPTION OF THE EMBODIMENTS

In the following, embodiments will be explained in detail with reference to the drawings.

First Embodiment

Figure 1:
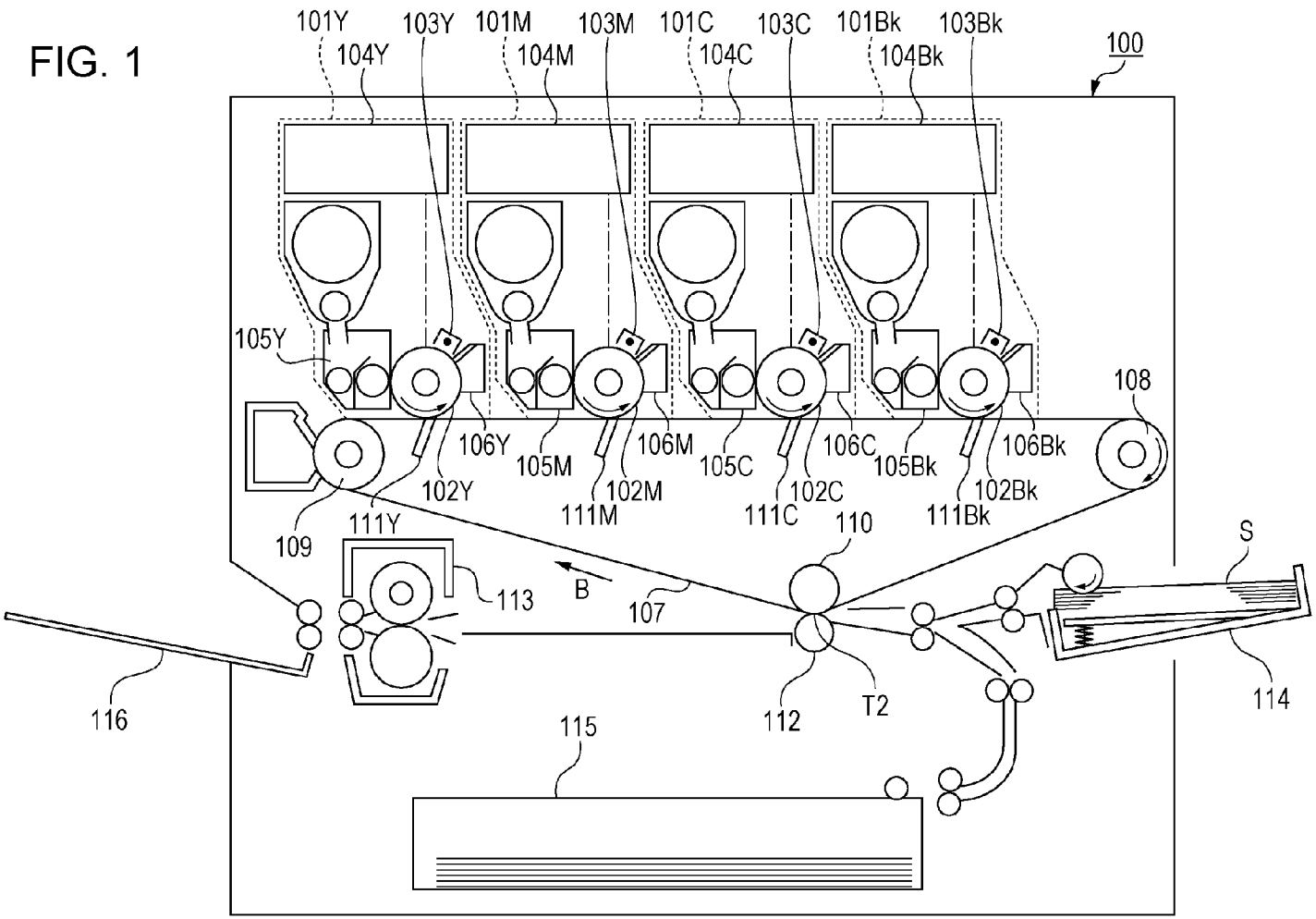
FIG. 1 is a diagram illustrating an example of the configuration of an image forming apparatus according to first and second embodiments.

FIG. 1 is a diagram illustrating an example of the configuration of an image forming apparatus according to a first embodiment.

In FIG. 1, an image forming apparatus 100 is configured as a full-color printer including image forming units 101Y, 101M, 101C, and 101Bk that perform image formation using yellow (Y) toner, magenta (M) toner, cyan (C) toner, and black (Bk) toner, respectively. Note that the image forming apparatus 100 is not limited to a full-color printer and may also be a monochrome printer, which performs image formation using toner of a single color (for example, black).

The image forming units 101Y, 101M, 101C, and 101Bk include photoconductor drums 102Y, 102M, 102C, and 102Bk, respectively, which serve as photoconductors. Charging devices 103Y, 103M, 103C, and 103Bk are arranged around the photoconductor drums 102Y, 102M, 102C, and 102Bk, respectively. Light scan units 104Y, 104M, 104C, and 104Bk are arranged around the photoconductor drums 102Y, 102M, 102C, and 102Bk, respectively. Developing devices 105Y, 105M, 105C, and 105Bk are arranged around the photoconductor drums 102Y, 102M, 102C, and 102Bk, respectively. Furthermore, drum cleaning units 106Y, 106M, 106C, and 106Bk are arranged around the photoconductor drums 102Y, 102M, 102C, and 102Bk, respectively.

An intermediate transfer belt 107 having an endless-belt form is arranged under the photoconductor drums 102Y, 102M, 102C, and 102Bk. The intermediate transfer belt 107 is stretched by a drive roller 108 and driven rollers 109 and 110 and is rotated and driven in a direction indicated by an arrow B in FIG. 1 during image formation. In addition, via the intermediate transfer belt 107 (an intermediate transfer member), primary transfer units 111Y, 111M, 111C, and 111Bk are arranged at respective positions facing the photoconductor drums 102Y, 102M, 102C, and 102Bk.

In addition, the image forming apparatus 100 includes a manual sheet cassette 114, a sheet cassette 115, a secondary transfer unit 112, which transfers a toner image on the intermediate transfer belt 107 to a recording medium S, a fixing unit 113, which fixes a toner image on a recording medium, and a sheet discharging unit 116.

Next, an image formation process in the image forming apparatus 100 will be explained, the image formation process covering from an electric charging step to a development step. Note that since image formation processes in the respective image forming units 101Y to 101Bk are identical, the image forming unit 101Y will be explained as an example and an explanation will be omitted for the image forming units 101M to 101Bk.

First, after the surface of the photoconductor drum 102Y, which is rotated and driven in a direction indicated by an arrow in FIG. 1, is electrically and uniformly charged by the charging device 103Y, exposure is performed by laser light emitted from the light scan unit 104Y and an electrostatic latent image is formed. The electrostatic latent image formed on the photoconductor drum 102Y is developed by the developing device 105Y and results in a yellow toner image. Likewise, a magenta toner image, a cyan toner image, and a black toner image are formed on the photoconductor drums 102M, 102C, and 102Bk, respectively. That is, the image forming apparatus 100 develops, using toner, an electrostatic latent image formed on a photoconductor drum 102 (a photoconductor) through exposure performed by laser light (a light beam).

Thereafter, a transfer bias is applied to the intermediate transfer belt 107 by the primary transfer units 111Y to 111Bk. As a result, the yellow, magenta, cyan, and black toner images formed on the photoconductor drums 102Y to 102Bk are sequentially transferred to the intermediate transfer belt 107, and a color toner image is formed by overlying the yellow, magenta, cyan, and black toner images.

Thereafter, the color toner image formed on the intermediate transfer belt 107 is transferred to a recording medium S (secondary transfer) by the secondary transfer unit 112, the recording medium S having been conveyed from the manual sheet cassette 114 or the sheet cassette 115 to the secondary transfer unit 112. Then, after the color toner image on the recording medium S is heated and fixed by the fixing unit 113, the recording medium S is discharged to the sheet discharging unit 116.

Note that after the first transfer is completed, residual toner that remains on the photoconductor drums 102Y to 102Bk is removed by the drum cleaning units 106Y to 106Bk. Thereafter, the above-described image formation process is performed for the next recording medium.

Figure 2:
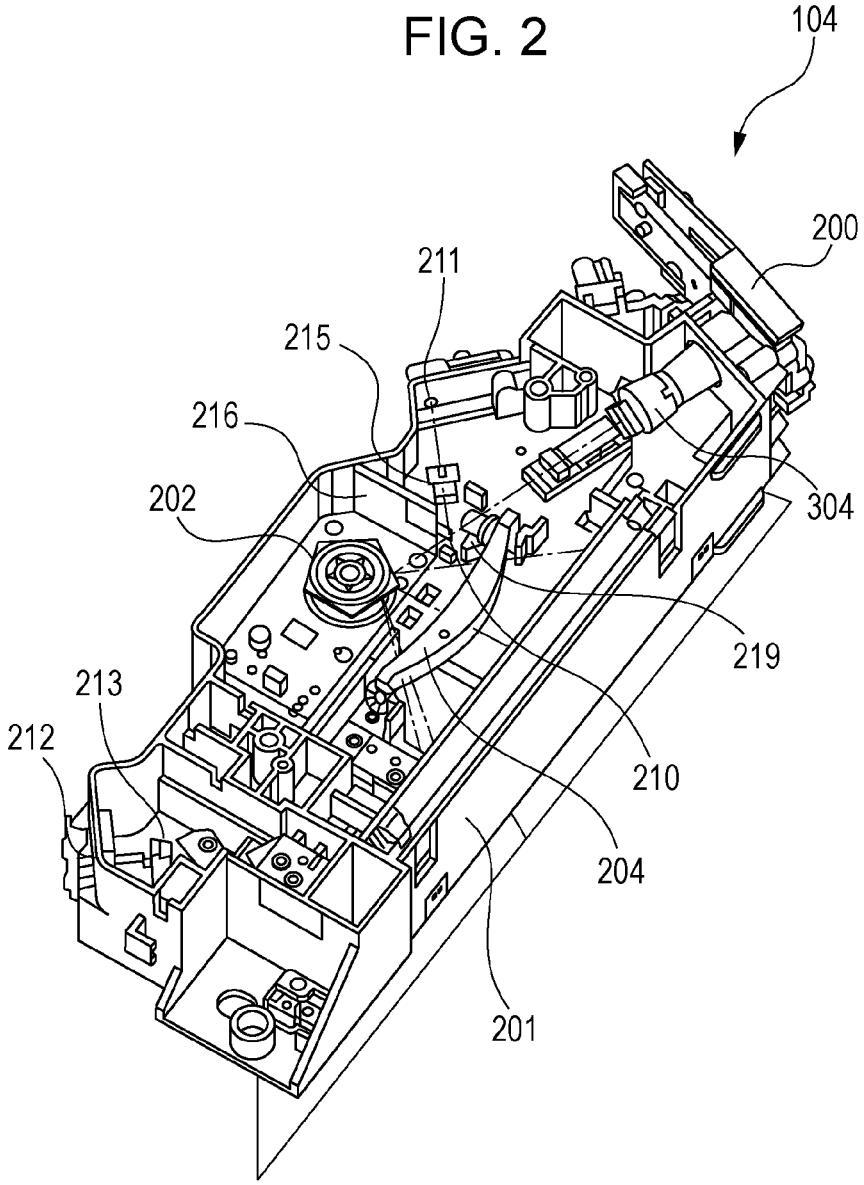
FIG. 2 is a perspective view illustrating a configuration of a light scan unit of the image forming apparatus.
Figure 3:
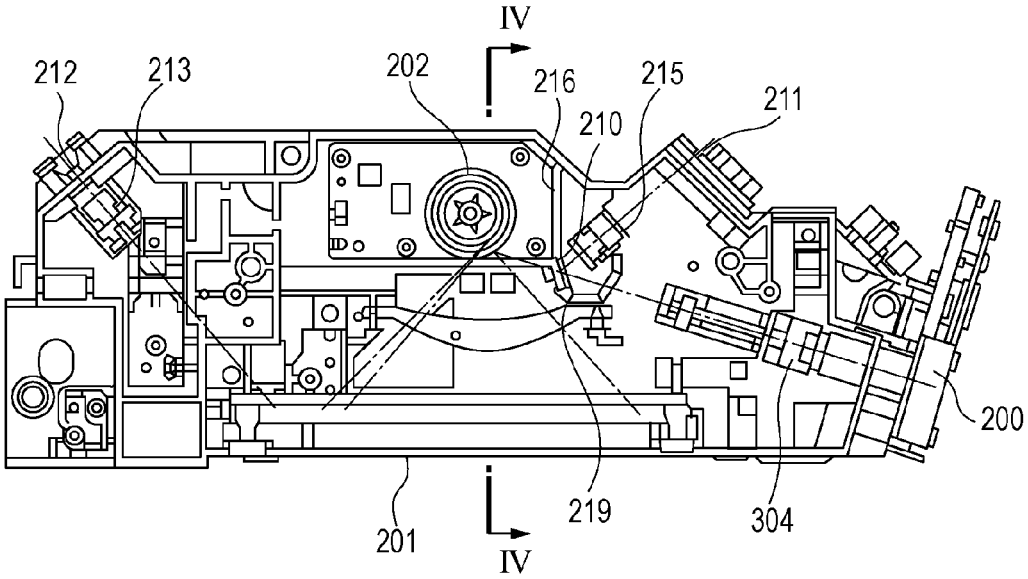
FIG. 3 is a top view illustrating the configuration of the light scan unit of the image forming apparatus.
Figure 4:
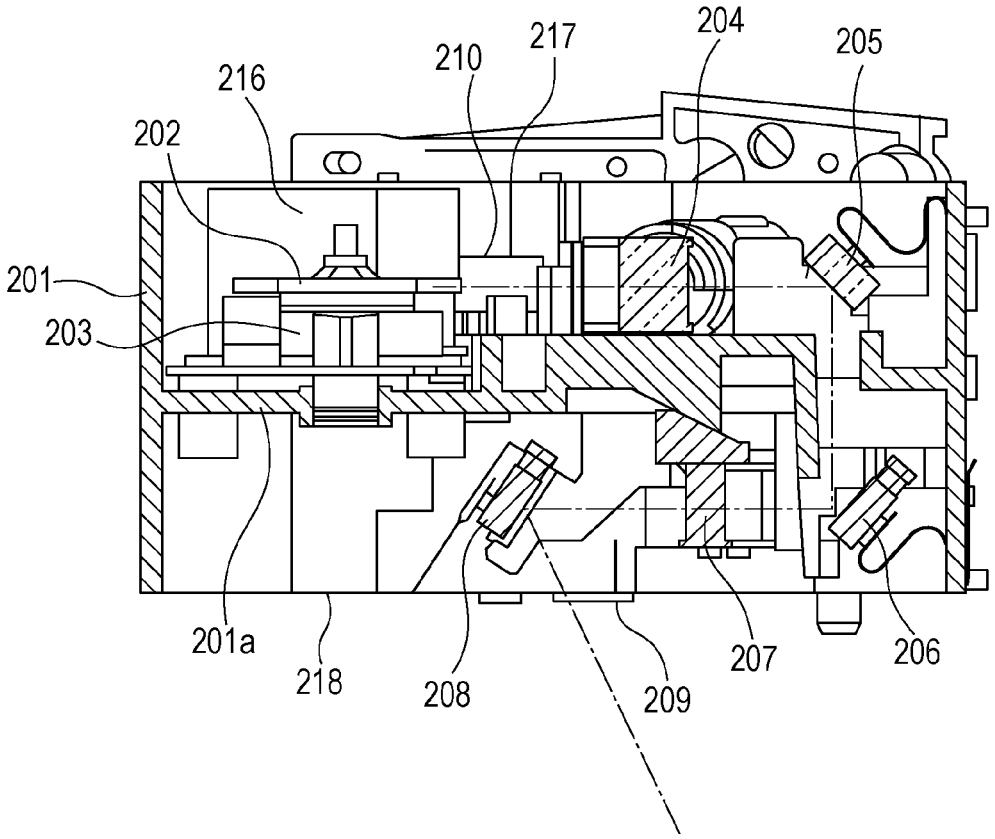
FIG. 4 is a cross section taken along line IV-IV of FIG. 3.
Figure 5:
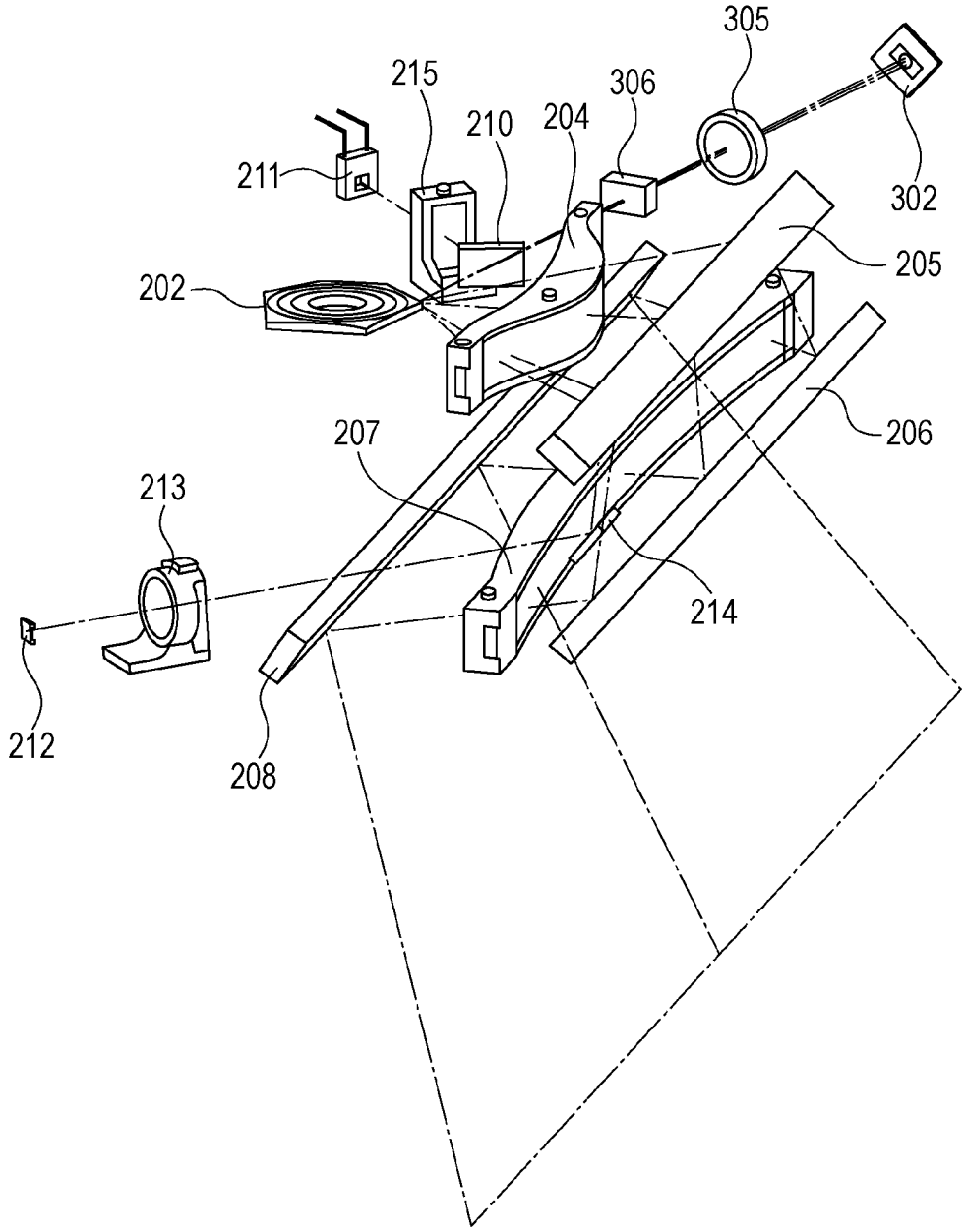
FIG. 5 is a perspective view illustrating arrangement of main optical components for each light scan unit.

FIG. 2 is a perspective view illustrating a configuration of each of the light scan units 104Y to 104Bk of the image forming apparatus 100. FIG. 3 is a top view illustrating a configuration of each of the light scan units 104Y to 104Bk. FIG. 4 is a cross section taken along line IV-IV of FIG. 3. FIG. 5 is a perspective view illustrating arrangement of main optical components for each of the light scan units 104Y to 104Bk. Note that since the configurations of the light scan units (also referred to as laser scanners) 104Y to 104Bk are identical, indices Y, M, C, and Bk will be omitted in the following explanation.

In FIGS. 2 to 5, an optical unit 200 is attached to an optical box 201 of a light scan unit 104, and a rotating polygon mirror 202, a first fθ lens 204, and the like are housed in the optical box 201. The rotating polygon mirror 202 (a deflection unit) is rotated and driven by a polygon motor 203, which is a DC motor, and deflects laser light emitted from the optical unit 200 such that laser light scans a photoconductor drum 102 in a certain direction. Note that the first fθ lens 204, reflection mirrors 205, 206, and 208, and a second fθ lens 207 correspond to an optical member.

The laser light deflected by the rotating polygon mirror 202 enters the first fθ lens 204. The first fθ lens 204 is positioned by a positioning portion 219 provided on a light-incident-surface side where laser light enters. The laser light that has passed through the first fθ lens 204 is reflected by the reflection mirrors 205 and 206 and enters the second fθ lens 207.

The laser light that has passed through the second fθ lens 207 is reflected by the reflection mirror 208, passes through a dust-proof glass 209, and is guided to the photoconductor drum 102. The laser light scanned at a uniform angular velocity using the rotating polygon mirror 202 forms an image on the photoconductor drum 102 through the first fθ lens 204 and the second fθ lens 207, and scans the photoconductor drum 102 at a constant speed.

The light scan unit 104 includes a beam splitter 210, which is a laser light (light beam) separation unit. The beam splitter 210 is arranged along an optical path of laser light emitted from the optical unit 200 toward the rotating polygon mirror 202 (between the optical unit 200 and the rotating polygon mirror 202). The laser light that has entered the beam splitter 210 is separated into first laser light (a first light beam), which is transmitted light, and second laser light (a second light beam), which is reflected light.

The beam splitter 210 has a light incident surface and a light emission surface. A certain coating (film) is formed on the light incident surface so as to achieve a constant reflectance (transmittance). The light emission surface has a slight difference in angle with respect to the light incident surface such that even when internal reflection occurs, laser light reflected by internal reflection is guided in a direction different from that of the second laser light reflected by the light incident surface. In other words, the light incident surface is not parallel to the light emission surface.

The first laser light, which is transmitted light that has entered the beam splitter 210, is deflected by the rotating polygon mirror 202 and guided to the photoconductor drum 102 as described above. The second laser light reflected by the light incident surface of the beam splitter 210 is guided in the direction away from the first fθ lens 204 with respect to a traveling direction of laser light emitted from the optical unit 200 and traveling toward the rotating polygon mirror 202. After passing through a condenser lens 215, the second laser light enters a photodiode (hereinafter referred to as a PD) 211, which is an optical sensor (a light receiving unit).

The condenser lens 215 is arranged along a path connecting the PD 211 with the beam splitter 210. The PD 211 is attached, from the outside of the optical box 201, to an opening provided on a side wall of the optical box 201. The second laser light that has passed through the condenser lens 215 enters the opening and the PD 211.

In order to miniaturize the light scan unit 104 and to reduce costs, no reflection mirror is arranged along an optical path of the second laser light. The PD 211 outputs a light intensity detection signal corresponding to a received light intensity. Automatic power control (APC), which will be described later, is performed in accordance with this light intensity detection signal. Note that the PD 211 may also be provided inside the optical box 201.

In addition, the light scan unit 104 includes a beam detector (hereinafter referred to as a BD) 212, which generates a synchronization signal to be used to determine an emission timing of laser light in accordance with image data on the photoconductor drum 102. The laser light (the first laser light) deflected by the rotating polygon mirror 202 passes through the first fθ lens 204, is reflected by the reflection mirror 205 and a reflection mirror 214, and enters the BD 212 (see FIG. 5).

The optical box 201 has a top opening surface and a bottom opening surface. Thus, a top cover 217 and a bottom cover 218 are attached to the optical box 201 and the inside is sealed (see FIG. 4).

Figure 6A:
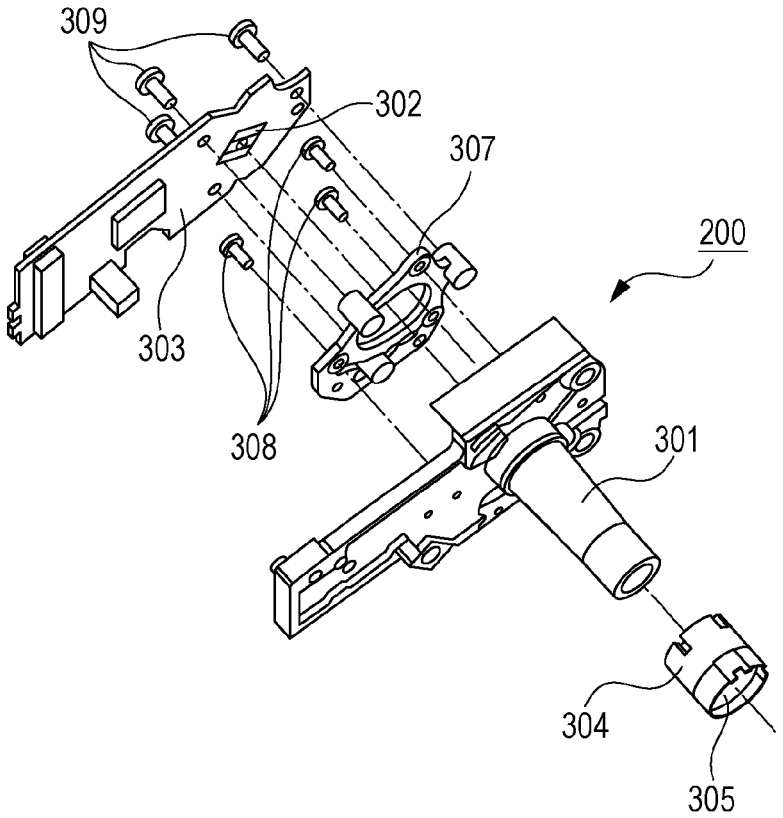
FIGS. 6A and 6B are perspective views illustrating exploded views of an optical unit of the light scan unit.
Figure 6B:
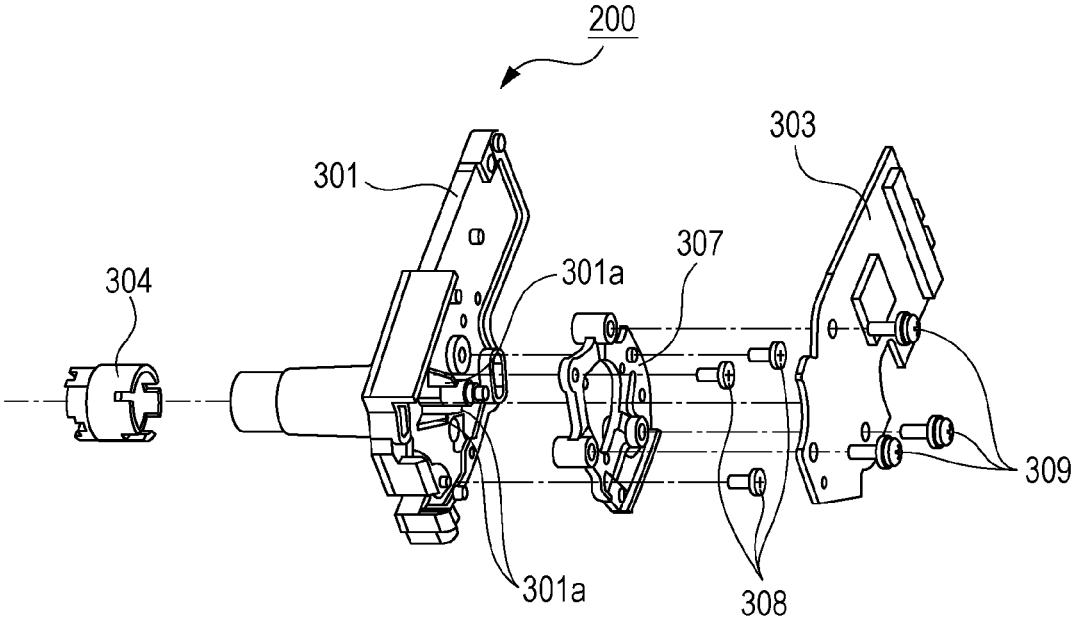

FIGS. 6A and 6B are perspective views illustrating exploded views of the optical unit 200 of the light scan unit 104. FIG. 6A is a perspective view seen from a lens-barrel side and FIG. 6B is a perspective view seen from a circuit-board side.

In FIG. 6A, the optical unit 200 includes a semiconductor laser 302 (for example, a vertical cavity surface emitting laser (VCSEL)). The semiconductor laser 302, in which a semiconductor laser 302A and a semiconductor laser 302B are arranged, is a light source that emits laser light (light beams), the semiconductor lasers 302A and 302B being described later. An electrical circuit board (hereinafter referred to as a circuit board) 303 is used to drive the semiconductor laser 302.

As illustrated in FIG. 6A, the semiconductor laser 302 is mounted on the circuit board 303. A laser holder 301 includes a barrel unit 304, and a collimator lens 305 is attached to an end of the barrel unit 304. The collimator lens 305 converts laser light (diverging light) emitted from the semiconductor laser 302 into parallel light rays. In the case where the light scan unit 104 is assembled, an irradiation position and focusing of laser light emitted from the semiconductor laser 302 are detected using a specific tool, and an installment position of the collimator lens 305 is adjusted with respect to the laser holder 301.

In the case where the installment position of the collimator lens 305 is determined, UV-curable adhesive applied between the collimator lens 305 and the barrel unit 304 is irradiated with ultraviolet light and the collimator lens 305 is adhered and fixed to the laser holder 301. The semiconductor laser 302 is electrically connected to the circuit board 303 and emits laser light in accordance with a driving signal supplied from the circuit board 303.

Next, fixture of the circuit board 303 to the laser holder 301 will be explained, the semiconductor laser 302 being mounted on the circuit board 303. As illustrated in FIG. 6A, three screw holes (fixing portions) into which screws 309 are screwed and three openings through which screws 308 penetrate are formed in a circuit board support member 307 formed of an elastic material. Each screw 309 penetrates through one of certain holes provided in the circuit board 303 and is screwed into a corresponding one of the screw holes provided in the circuit board support member 307. In addition, each screw 308 penetrates through a corresponding one of the openings of the circuit board support member 307 and is screwed into one of certain screw holes provided in the laser holder 301. As a result, the circuit board 303 is fixed to the laser holder 301 by the circuit board support member 307.

In the case where the optical unit 200 is assembled, first, the circuit board support member 307 is fixed to the laser holder 301 with the screws 308. Next, the semiconductor laser 302 mounted on the circuit board 303 is pressed against three abutting units 301*a* (see FIG. 6B) provided in the laser holder 301. There is a gap between the circuit board support member 307 and the circuit board 303. Next, by fixing with the screws 309, the circuit board support member 307 is elastically deformed into a bow shape protruding toward the laser holder 301. The circuit board 303 is pressed against the abutting units 301*a* by the restoring force, and the semiconductor laser 302 is fixed to the laser holder 301.

Figure 7:
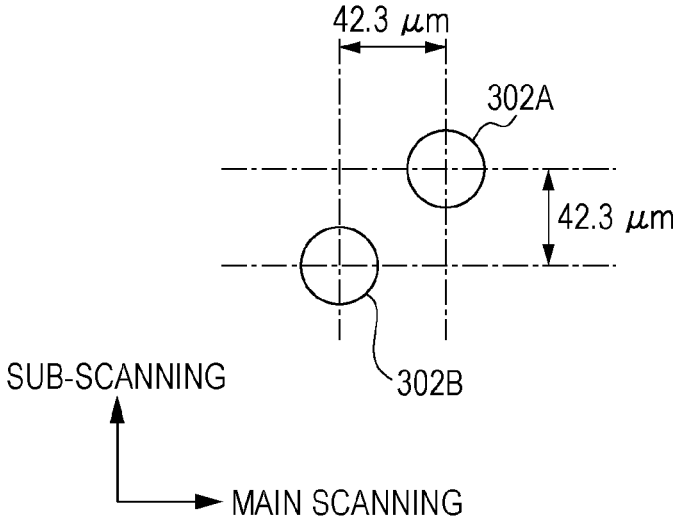
FIG. 7 is a diagram illustrating arrangement of laser spots of a VCSEL on the photoconductor drum, the VCSEL being a semiconductor laser of the optical unit.

FIG. 7 is a diagram illustrating arrangement of laser spots of the semiconductor laser 302 on the photoconductor drum 102, the semiconductor laser 302 being a semiconductor laser of the optical unit 200.

In FIG. 7, the semiconductor laser 302 is a 2-beam laser inclined by 45 degrees, and is designed such that unity magnification projection is performed from a laser chip surface onto the photoconductor drum 102. A sub-scanning pitch and a main-scanning pitch of a laser A (the semiconductor laser 302A) and a laser B (the semiconductor laser 302B) are 600 dpi (42.3 μm). The semiconductor laser 302 is attached to the circuit board 303 such that the laser A precedes both in main-scanning and in sub-scanning. Acquisition of a BD signal is always performed by scanning light of the laser A.

Next, nonuniformity in four image densities handled in the first embodiment (nonuniformity in first to fourth image densities) will be explained.

Figure 8A:
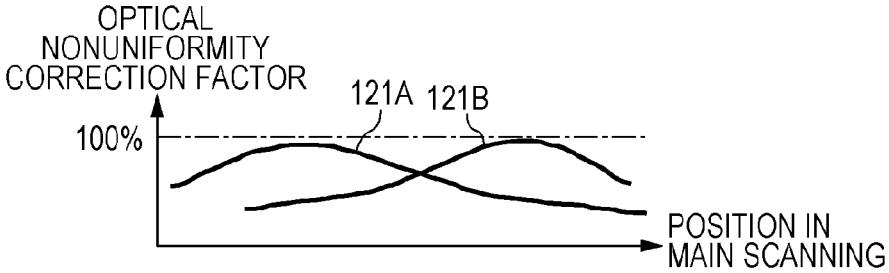
FIGS. 8A to 8D are diagrams illustrating examples of images printed by the image forming apparatus.
Figure 8B:
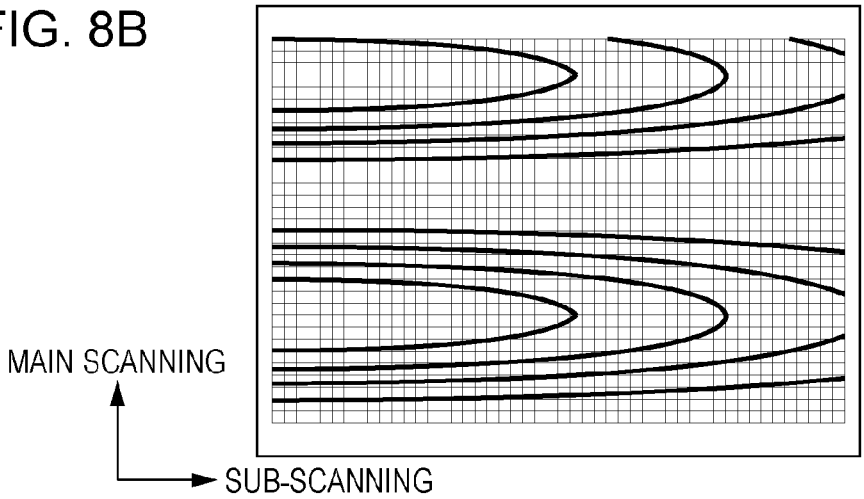
Figure 8C:
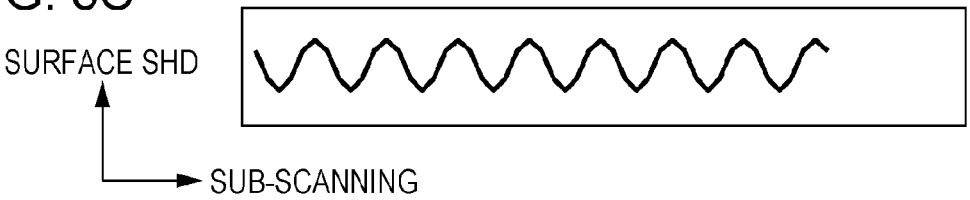
Figure 8D:
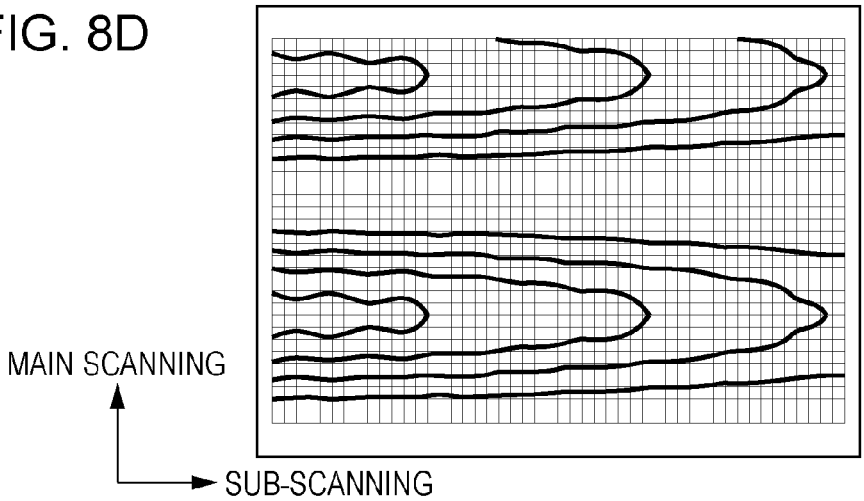

FIGS. 8A to 8D are diagrams illustrating an example of an image printed by the image forming apparatus 100. FIG. 8A is a diagram illustrating an example of a first profile corresponding to the optical nonuniformity of the laser A and an example of a second profile corresponding to the optical nonuniformity of the laser B. FIG. 8B is a diagram illustrating an example of a third profile corresponding to the nonuniformity of a two-dimensional region (a longitudinal direction and a circumferential direction) of one photoconductor drum. FIG. 8C is a diagram illustrating an example of a fourth profile corresponding to nonuniformity in the optical face tangle error of the rotating polygon mirror 202, and FIG. 8D is a diagram illustrating an example of a correction profile in which the third and fourth profiles are superimposed.

In FIG. 8A, a first profile 121A differs from a second profile 121B (pieces of second correction data, which are a profile for correcting nonuniformity in density) because there are differences between the laser A and the laser B in terms of distribution of emitted light (an emission angle) and in terms of light wavelengths. Here, the optical nonuniformity correction factor represented by the vertical axis of FIG. 8A is a correction factor for the case where a change in light intensity of laser light guided onto the photoconductor drum 102 is corrected, the change being caused by the optical characteristics of the optical member in a scanning direction in which a plurality of laser light beams scan the photoconductor drum 102.

Then, a density difference occurs because of a difference in refraction factor and a difference in optical path between a group of lenses (the first fθ lens 204 and the second fθ lens 207) having power in the main scanning direction and a group of mirrors (the rotating polygon mirror 202 and the reflection mirrors 205, 206, and 208). In the density difference distribution, the change in light intensity is 10% within about a period of 40 mm with respect to 300 mm in the main scanning direction. The change in light intensity gradually changes. In other words, the pieces of second correction data are used for correction of changes in light intensity of laser light guided onto the photoconductor drum 102, the change being caused by the optical characteristics of the optical member in a scanning direction in which a plurality of laser light beams scan the photoconductor drum 102.

In FIG. 8B, the distribution of nonuniformity in density within an image extends in the longitudinal direction and the circumferential direction of the photoconductor drum 102. The change in light intensity is 10% within about a period of 20 mm. The distribution of the nonuniformity in density within an image gradually changes. Here, the final exposure sensitivity of a surface of the photoconductor drum 102 is set such that the effect of a difference in wavelength between two lasers becomes significantly small.

In FIG. 8C, the nonuniformity in the optical face tangle error of the rotating polygon mirror 202 has a five-face period depending on one rotation period of the rotating polygon mirror 202 having five mirror faces, and sub-scan line pitch compressions and rarefactions appear as the nonuniformity in density. Then, when the third and fourth profiles are superimposed, a correction profile illustrated in FIG. 8D is obtained.

In the image forming apparatus 100, replacement parts each of which is equipped with a non-volatile memory, the replacement parts being causes of the nonuniformity in four image densities of the above-described three types, and the following correction is performed. That is, correction profile data are measured in advance after manufacturing and assembly in a factory, pieces of correction data are generated and recorded, and correction is performed as in the following when an image is formed by the image forming apparatus 100.

Figure 9:
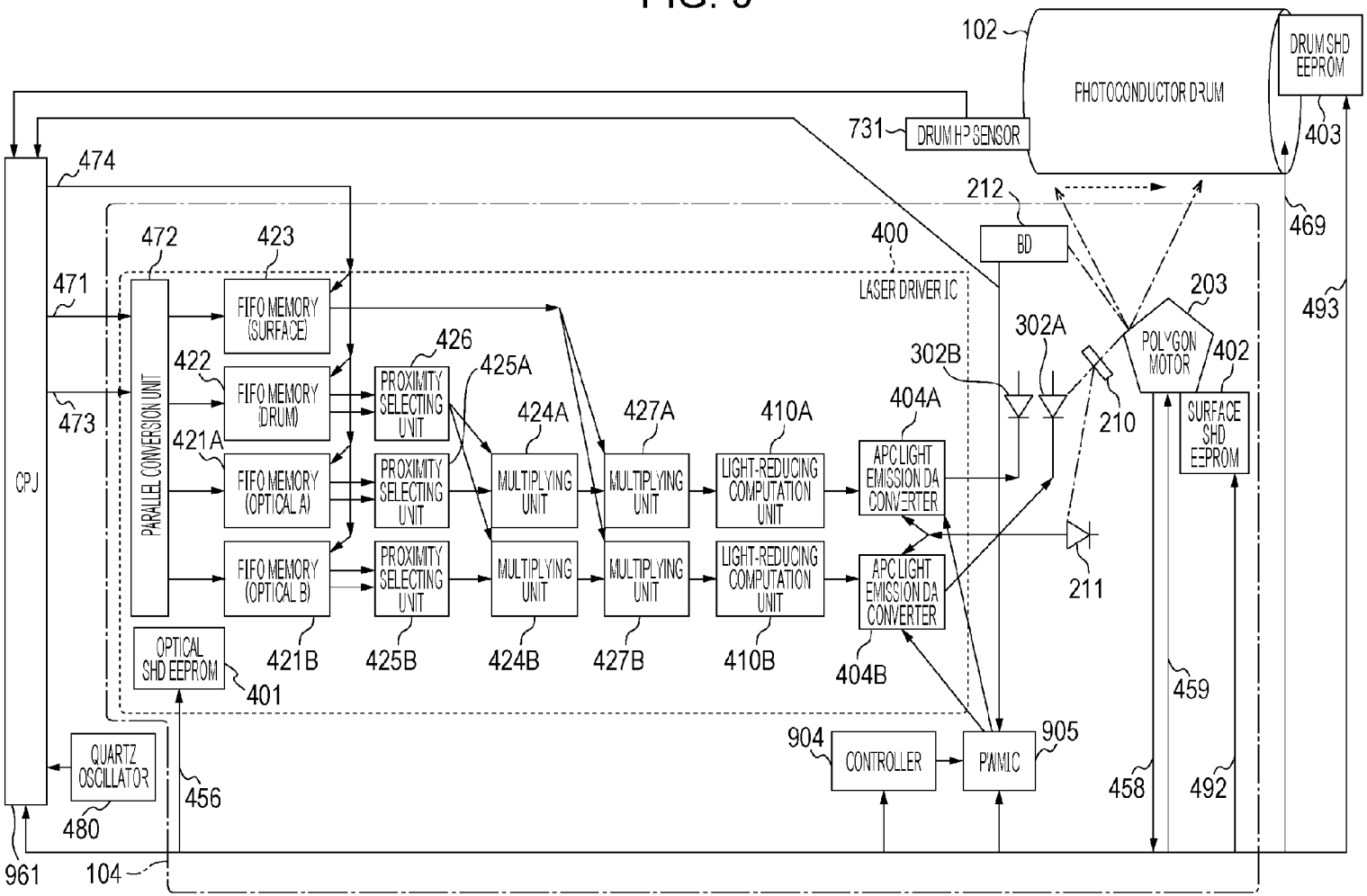
FIG. 9 is a block diagram illustrating an example of the configuration of at least one embodiment of a control system of the image forming apparatus.

FIG. 9 is a block diagram illustrating an example of the configuration of a control system of the image forming apparatus. Note that since the light scan units (also referred to as laser scanners) 104Y, 104M, 104C, and 104Bk are identical, indices Y, M, C, and Bk will be omitted in the following explanation.

In FIG. 9, a CPU 961 is connected to a laser scanner 104 having a printer image controller (hereinafter simply referred to as a controller) 904 and a laser driver IC 400. The CPU 961 is mounted on a rear circuit board (not illustrated) of the main body of the image forming apparatus 100 spaced apart from the circuit board 303, and performs overall control on the laser scanner 104 and the entirety of the image forming apparatus 100. The CPU 961 is connected via serial communication so as to cause image engine control to function in collaboration and synchronization with the controller 904 in a command communication level. The CPU 961 receives an operation clock of 20 MHz supplied from a quartz oscillator 480.

The laser scanner 104 further includes a surface SHD EEPROM 402, a pulse width modulation (PWM) IC 905, and the like in addition to the controller 904 and the laser driver IC 400. The laser driver IC 400 includes an optical SHD EEPROM 401, a parallel conversion unit 472, FIFO memories 423, 422, 421A, and 421B, and proximity selecting units 426, 425A, and 425B. Furthermore, multiplying units 424A, 424B, 427A, and 427B, light-reducing computation units 410A and 410B, and APC light emission DA converters 404A and 404B.

The controller 904 separates image data received from the outside of the image forming apparatus 100 into four groups in terms of color. Furthermore, the controller 904 performs a screen process on image data, converts the image data into bitmap data having a laser spot resolution, controls the PWMIC 905 in synchronization with a BD signal, and outputs a PWM light emission signal that causes to a 2-beam laser to perform blinking to the laser driver IC 400.

The laser driver IC 400 is mounted on the circuit board 303 and drives the semiconductor lasers (light sources) 302A and 302B. In addition, the laser driver IC 400 is connected to the PD 211 and executes APC. The laser driver IC 400 drives the semiconductor lasers 302A and 302B in accordance with a PWM light emission signal and corrects the surface light intensity of the photoconductor drum 102 and nonuniformity with reference to an APC light intensity. Note that the PWMIC 905 and the laser driver IC 400 may also be provided as one IC.

Non-volatile memories with which the above-described replacement parts are equipped correspond to the following EEPROMs. The optical SHD EEPROM 401 is a non-volatile memory unit (a second storage unit) in which pieces of correction data (pieces of second correction data) for correcting changes in light intensity of laser light guided onto the photoconductor drum 102 are stored, the changes being caused by the optical characteristics of the optical member in a scanning direction. The optical SHD EEPROM 401 corresponds to the second storage unit of the first embodiment. The optical SHD EEPROM 401 is included in the laser driver IC 400 and connected to the CPU 961 via a serial communication line 455.

The surface SHD EEPROM 402 is a non-volatile storage unit (a third storage unit) in which pieces of correction data for correcting differences in terms of light intensity between reflecting surfaces of a polygon mirror on the photoconductor drum 102 are stored, the differences being caused by reflectance differences between reflecting surfaces of the polygon mirror. The surface SHD EEPROM 402 is connected to the CPU 961 via a serial communication line 492.

A drum SHD EEPROM 403 is a non-volatile storage unit (a first storage unit) in which pieces of correction data (pieces of first correction data) for correcting differences in terms of electric potential characteristics between regions of the photoconductor drum 102 are stored. The drum SHD EEPROM 403 corresponds to the first storage unit of the first embodiment. The drum SHD EEPROM 403 is connected to the CPU 961 via a serial communication line 493.

Here, characteristics of the first embodiment will be explained.

The CPU 961 (a control unit) of the image forming apparatus 100 performs the following control. During scanning of the photoconductor drum 102 by laser light, laser light is controlled so as to have a certain light intensity corresponding to a scan position of the laser light in the main scanning direction in accordance with a piece of first correction data and a piece of second correction data read from the drum SHD EEPROM 403 and the optical SHD EEPROM 401, respectively. In a period in which laser light scans once across the photoconductor drum 102 (hereinafter referred to as a one-scan-line period), the timing (the output timing) at which the CPU 961 reads a piece of first correction data from the drum SHD EEPROM 403 matches, at least once, the timing (the output timing) at which the CPU 961 reads a piece of second correction data from the optical SHD EEPROM 401.

In addition, there is an integral multiple relationship between a first-correction-data read period in which the CPU 961 reads a piece of first correction data from the drum SHD EEPROM 403 (an output period in which the drum SHD EEPROM 403 outputs a piece of first correction data) and a second-correction-data read period in which the CPU 961 reads a piece of second correction data from the optical SHD EEPROM 401 (an output period in which the optical SHD EEPROM 401 outputs a piece of second correction data).

The relationship between the first-correction-data read period and the second-correction-data read period may be any of the followings. The second-correction-data read period is an integral multiple of the first-correction-data read period. Specifically, the second-correction-data read period is the same as the first-correction-data read period. Alternatively, the second-correction-data read period is an n-multiple of the first-correction-data read period (n 2, n is a natural number) (multiplied by two or greater).

In addition, the CPU 961 (a signal generation unit) reads a piece of first correction data and a piece of second correction data from the drum SHD EEPROM 403 and the optical SHD EEPROM 401, respectively, in synchronization with a clock signal. Furthermore, the CPU 961 generates a piece of third correction data through computation in synchronization with a clock signal, the piece of third correction data being data for controlling the light intensity of laser light in accordance with the pieces of read first and second correction data.

Note that the CPU 961 may also read a piece of correction data from the surface SHD EEPROM 402 for each reflecting surface where laser light enters, and compute a piece of third correction data as in the following. That is, a piece of third correction data may also be computed in synchronization with a clock signal in accordance with pieces of read first and second correction data and the piece of correction data read from the surface SHD EEPROM 402, the piece of third correction data being data for controlling the light intensity of laser light. Note that, desirably, the timing at which a piece of correction data corresponding to each reflecting surface is read from the surface SHD EEPROM 402 is a timing as in the following. That is, desirably, before laser light enters each reflecting surface, the timing at which a piece of correction data is read from the surface SHD EEPROM 402 is the same as at least one of the timing at which a piece of first correction data is read and the timing at which a piece of second correction data is read.

Note that after the power of the image forming apparatus 100 is switched ON, the CPU 961 may also perform the following process. That is, pieces of correction data are read from the drum SHD EEPROM 403, the optical SHD EEPROM 401, and the surface SHD EEPROM 402 and stored in a storage unit connected to the CPU 961. Then, each piece of correction data may also be read from the storage unit at the timing similar to the above-described timing.

In addition, for positions each of which is between adjacent scan positions among a plurality of scan positions, the CPU 961 generates, for each of the positions, a piece of first interpolated data in accordance with pieces of first correction data corresponding to adjacent scan positions corresponding to the position (interpolated data generation). Furthermore, for the positions each of which is between adjacent scan positions among a plurality of scan positions, the CPU 961 generates, for each of the positions, a piece of second interpolated data in accordance with pieces of second correction data corresponding to adjacent scan positions corresponding to the position (interpolated data generation). Furthermore, the CPU 961 generates a piece of third correction data by computation in accordance with the piece of first interpolated data and the piece of second interpolated data.

Here, in a one-scan-line period, reading of pieces of first correction data from the drum SHD EEPROM 403 and reading of pieces of second correction data from the optical SHD EEPROM 401 are executed in accordance with a count value as in the following in the control system of FIG. 9. The reading is executed in accordance with a count value of a first counter (which counts an HCLK to be described later), not illustrated, with reference to a BD signal. That is, pieces of first correction data and pieces of second correction data are stored as a plurality of pieces of data corresponding to count values in the drum SHD EEPROM 403 and the optical SHD EEPROM 401, respectively. Then, the drum SHD EEPROM 403 and the optical SHD EEPROM 401 output a piece of data corresponding to a count value, in accordance with an instruction from the CPU 961.

Furthermore, reading of pieces of first correction data from the drum SHD EEPROM 403 in a one-scan-line period is executed in accordance with a second counter (which counts a VCLK to be described later), not illustrated, with reference to a drum HP signal. That is, pieces of first correction data are stored as a plurality of pieces of data corresponding to count values in the drum SHD EEPROM 403, and the drum SHD EEPROM 403 outputs a piece of data corresponding to a count value in accordance with an instruction from the CPU 961.

Figure 10:
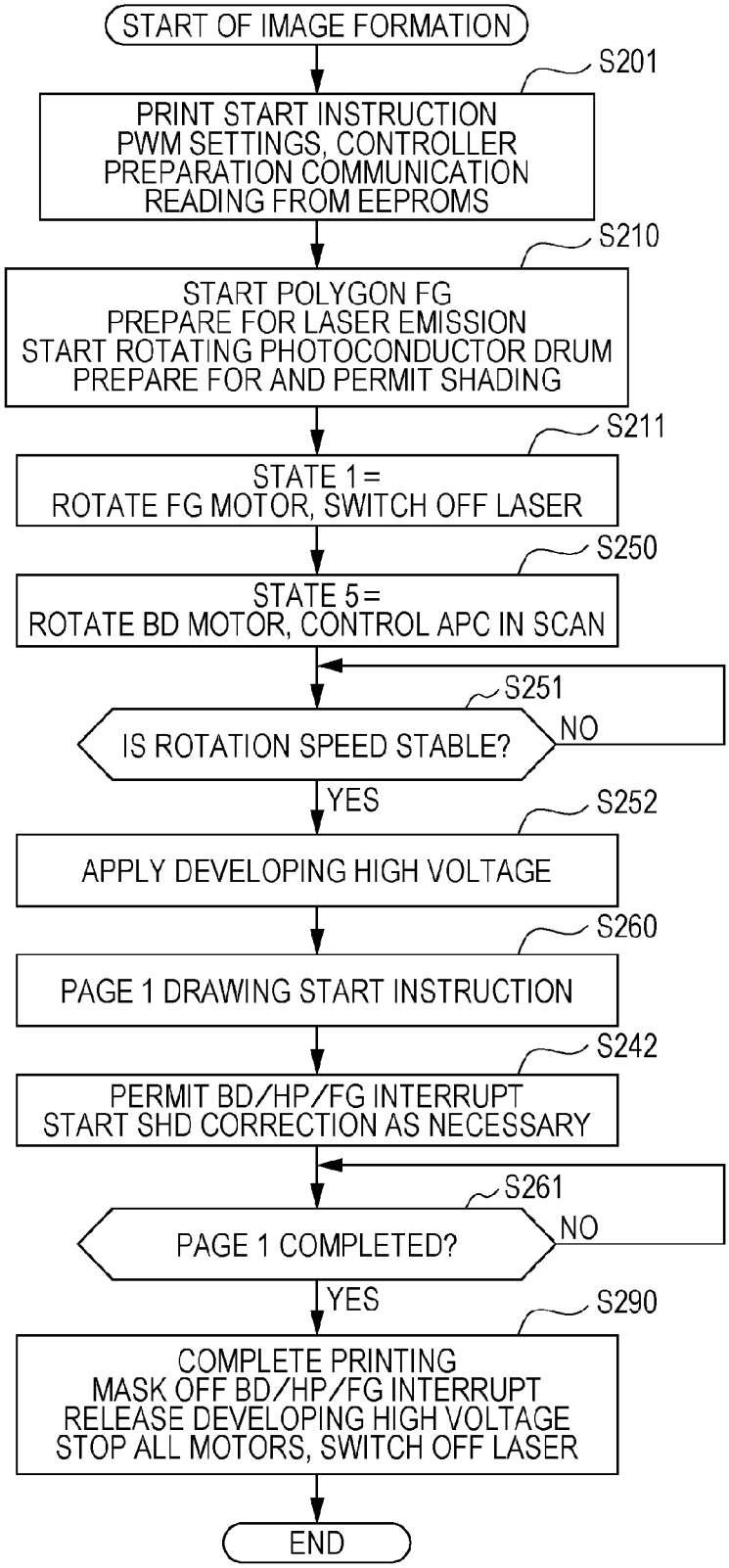
FIG. 10 is a flowchart illustrating an example of control performed when an image is formed by a CPU of the image forming apparatus.

FIG. 10 is a flowchart illustrating an example of control performed when an image is formed by the CPU 961 of the image forming apparatus 100.

In FIG. 10, first, when a print instruction is input to the controller 904 from an operation unit (not illustrated) of the image forming apparatus 100, the controller 904 sends an image formation preparation instruction to the CPU 961. As a result, the CPU 961 sets PWM settings and performs reading from EEPROMs (step S201).

Next, the CPU 961 drives the rotating polygon mirror 202 so as to rotate by driving the polygon motor 203. Furthermore, the CPU 961 inputs a rotating state detection signal (a rotation position signal, which is hereinafter referred to as an FG signal) 458 from a motor driver IC (not illustrated) built in the polygon motor 203, the rotating state detection signal 458 being a signal with which a specific mirror face may be determined among five mirror faces. The CPU 961 outputs a rotation instruction signal 459 to the motor driver IC in accordance with the FG signal 458. Upon receiving the rotation instruction signal 459, the motor driver IC performs feedback control on the polygon motor 203 such that the rotation speed of the rotating polygon mirror 202 becomes a predetermined rotation speed (step S210).

In addition, the CPU 961 sends an instruction regarding a rotation operation of the photoconductor drum 102. As a result, every time the photoconductor drum 102 performs one rotation, a drum HP signal for one rotation is input from a drum HP sensor 731 to the CPU 961. The CPU 961 determines a rotation position of the photoconductor drum 102 through a timer function through which time measurement is performed with reference to a drum HP signal. Note that a time period necessary for the photoconductor drum 102 to perform one rotation is, for example, about 800 msec.

Next, the CPU 961 prepares for APC. The CPU 961 sends a control instruction for APC to the laser driver IC 400 in accordance with serial register settings. The laser driver IC 400 writes the control instruction in a built-in memory.

First, the CPU 961 sets, in the laser scanner 104, register settings for an adjustment amount of a maximum laser light intensity (an APC light intensity), which is a target. The CPU 961 reads a register setting value from the optical SHD EEPROM 401. Note that in the case where a laser scanner unit is assembled in advance, the register setting value is written into the optical SHD EEPROM 401 such that a light intensity at an irradiated surface position of the BD 212 becomes a predetermined light intensity when measurement and adjustment are performed in a factory. Then, the register setting value is stored in the optical SHD EEPROM 401 as an adjustment amount for the laser scanner unit. Note that, for each laser, pre-settings for correction are set in units of 8 bits per one register.

In addition, the CPU 961 prepares for laser light intensity shading (laser light intensity modulation, which is hereinafter referred to as SHD) control. After this preparation, the CPU 961 enters a state in which the CPU 961 waits for a reference position signal to be input for APC and for SHD (step S210).

Upon detecting, from the FG signal 458, that the rotation speed of the rotating polygon mirror 202 has reached a predetermined rotation speed, the CPU 96 instructs the laser driver IC 400 to start APC. Then, when APC feedback control on the semiconductor laser 302A becomes stable, the semiconductor laser 302A enters a state in which laser light having an intensity sufficient for acquisition of a BD signal may be emitted and the CPU 961 detects a BD signal.

Thereafter, the CPU 961 goes into sequence light emission control in which APC is performed on all the lasers in an area other than a photoconductor-drum region in the main scanning direction with reference to the BD signal. As a result, feedback control on the semiconductor laser 302B becomes stable. The CPU 961 performs light emission control in accordance with a PWM light emission signal in the photoconductor-drum region in the main scanning direction (hereinafter referred to as a video region); however, at the beginning of startup, laser emission is not performed since image data has not been transferred (step S211).

Subsequently, the CPU 961 goes from control of the polygon motor 203 according to the FG signal 458 into control of the polygon motor 203 according to a BD signal (step S250). Then, the CPU 961 determines whether or not the rotation speed of the polygon motor 203 has become stable (step S251). In the case where it is determined that the rotation speed of the polygon motor 203 has not become stable (NO in step S251), the CPU 961 is on standby.

In contrast, in the case where it is determined that the rotation speed of the polygon motor 203 has become stable after a predetermined time period has passed (YES in step S251), the CPU 961 allows a developing device 105 to apply a developing high voltage bias as a drawing start preparation (step S252).

Next, the CPU 961 instructs the controller 904 to start drawing (step S260). As a result, the controller 904 starts drawing corresponding to image data of the first surface. In this case, image data in units of lines are transferred from the controller 904 to the PWMIC 905, in accordance with BD synchronization with reference to the BD signal.

The PWMIC 905 performs laser PWM modulation on the image data in units of pixels, and sends the modulated image data as differential binary signals of two lasers to the APC light emission DA converters 404A and 404B. The laser driver IC 400 drives the semiconductor lasers (the laser light emitting elements) 302A and 302B to emit light by treating the maximum light intensity as an APC light intensity and using the amount of current obtained by subtracting the amount of current necessary for driving of the light-reducing computation units 410A and 410B. The path along which laser light travels to the photoconductor drum 102 and the BD 212 has been explained in FIG. 9.

Note that, after the process in step S260, the CPU 961 permits a BD signal, an HP signal, and an FG signal to interrupt and also starts SHD correction as necessary step S242).

Subsequently, the CPU 961 determines whether or not printing of one page has been completed (step S261). In the case where printing of one page has not been completed (NO in step S261), the CPU 961 is on standby. In contrast, in the case where printing of one page has been completed (YES in step S261), the CPU 961 stops motors and also switches off lasers. Furthermore, the CPU 961 masks off interruptions generated by a BD signal, an HP signal, and an FG signal and also releases the developing high voltage bias (step S290), and then this process ends.

Here, an SHD operation performed by the CPU 961 and the laser driver IC 400 will be explained.

The overall SHD control is performed in the following six steps. (1) First, prepare pieces of correction data in a memory (a first preparation operation). (2) Second, generate and input a reference position signal. (3) Third, determine a scan position (that is, an exposure position) through time measurement from the reference position signal. (4) Fourth, perform computation in the outside of the laser driver IC 400 and transfer. (5) Fifth, compute pieces of data at correction positions in the laser driver IC 400. (6) Sixth, perform laser electric-current modulation during PWM light emission in the laser driver IC 400.

The first preparation operation is performed in step S210. The CPU 961 and the laser driver IC 400 are connected by a register communication interface, and a laser light intensity correction timing signal (a shading clock, which is hereinafter referred to as a SHDCLK) 474 is supplied from the CPU 961 to the laser driver IC 400. The CPU 961 reads setting values for first and second nonuniformity correction (hereinafter referred to as optical SHD) from the optical SHD EEPROM 401. In the case where a laser scanner unit is assembled in advance, the setting values are written into the optical SHD EEPROM 401 such that a light intensity at an irradiated surface position in each image height becomes a predetermined light intensity when measurement and adjustment are performed in a factory.

An optical-SHD control instruction is written into the FIFO memories 421A and 421B of the laser driver IC 400 in accordance with a serial register setting. For this setting, 17 pieces of data each of which is represented by 8 bits (256 levels of gray) are prepared with a spacing of 20 mm therebetween in the main scanning direction of each laser, and writing is performed in 34 registers in total.

The CPU 961 reads setting values for third nonuniformity correction (hereinafter referred to as drum SHD) from the drum SHD EEPROM 403. In the case where a photoconductor drum unit is assembled in advance, the setting values (adjustment amounts) are written into the drum SHD EEPROM 403 such that a light intensity at an irradiated surface position of a drum surface defined by each image height and a time from an HP signal becomes a predetermined light intensity when measurement and adjustment are performed in a factory.

A drum-SHD control instruction is written into a drum SHD memory of the CPU 961. This setting is prepared for 33 points in the main scanning direction and 32 points in the sub-scanning direction with a spacing of 10 mm therebetween in a two-dimensional lattice form. Here, 1 data has 8 bits (256 levels of gray), and 1056 registers in total are used and writing is performed in units of 8 bits.

The CPU 961 reads setting values for fourth nonuniformity correction (hereinafter referred to as surface SHD) from the surface SHD EEPROM 402. The setting values are written as in the following. In the case where a laser scanner unit is assembled in advance, the setting values are written into the surface SHD EEPROM 402 such that nonuniformity in shades of gray between adjacent faces for all the faces of a polygon mirror defined by a time from the FG signal 458 is reduced to a predetermined nonuniformity when measurement and adjustment are performed in a factory.

A surface-SHD control instruction is written into a surface SHD memory of the CPU 961. This setting is prepared for sub-scan lines the number of which corresponds to one rotation of the rotating polygon mirror 202. Since 1 point is represented by 8 bits (256 levels of gray) and 2 lasers each have 5 faces, 10 registers in total are used and writing is performed in units of 8 bits.

The CPU 961 performs drum motor control in accordance with an HP signal supplied from the drum HP sensor 731 and performs constant-speed rotation control on the photoconductor drum 102. In other words, the CPU 961 performs feedback control such that the period of an HP signal becomes stable and constant. In addition, the CPU 961 performs constant-speed rotation control on the polygon motor 203 when APC becomes stable. In other words, the CPU 961 performs feedback control such that the period of a BD signal supplied from the BD 212 becomes almost constant.

The CPU 961 treats the HP signal and the BD signal as interrupt signals and furthermore the FG signal 458 as a surface determination signal, and outputs a periodic signal regarding rotation of the rotating polygon mirror 202 in the main scanning direction and the sub-scanning direction.

Figure 11A:
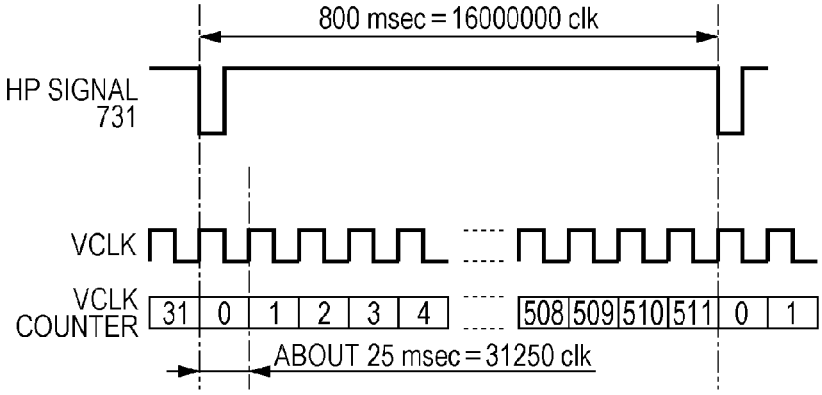
FIGS. 11A to 11C are diagrams illustrating a periodic signal output from the CPU of the image forming apparatus.
Figure 11B:
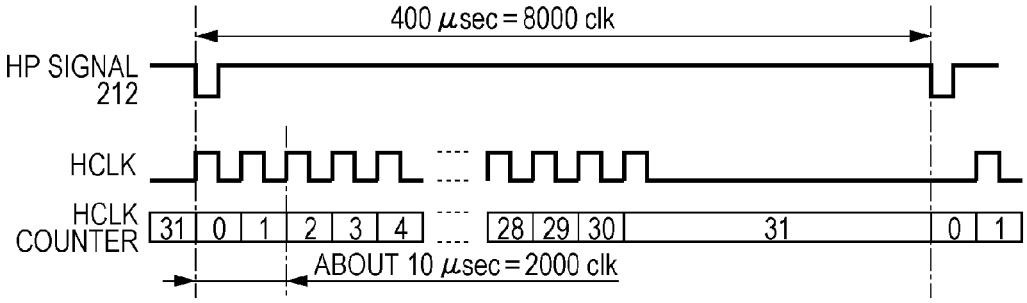
Figure 11C:
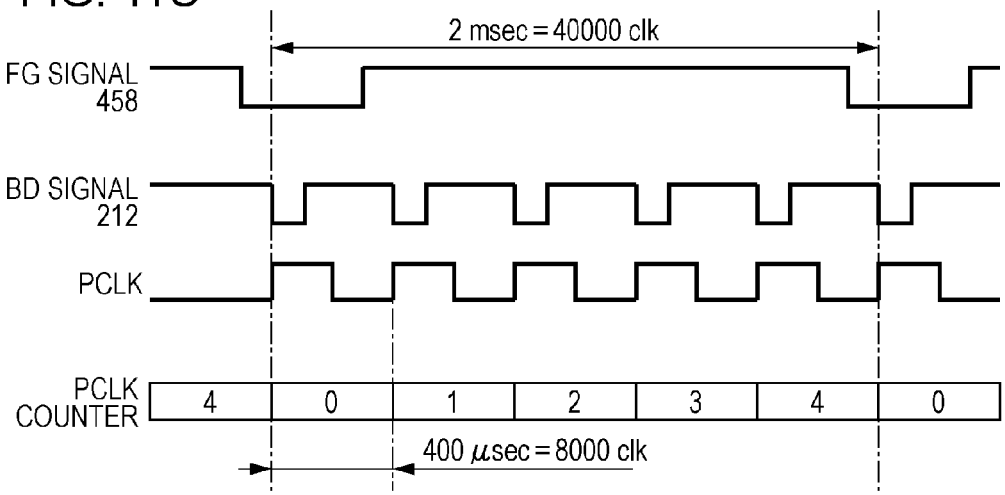

FIGS. 11A to 11C are diagrams illustrating periodic signals output from the CPU 961 of the image forming apparatus 100. FIG. 11A is a diagram illustrating a drum counter clock, which is a periodic signal regarding the sub-scanning direction, and FIG. 11B is a diagram illustrating a drum counter clock, which is a periodic signal regarding the main scanning direction. FIG. 11C is a diagram illustrating a polygon-face counter clock, which is a periodic signal regarding polygon rotation.

The CPU 961 generates a drum counter clock, which is a drum sub-scanning periodic signal illustrated in FIG. 11A, (a first clock signal having a predetermined frequency, which is hereinafter referred to as a VCLK). The CPU 961 resets a VCLK timer counter (a first counter) with reference to the falling edge of a HP signal. Then, from a first predetermined time to a second predetermined time in a one-scan-line period, the CPU 961 generates a clock signal having a period of about 1.6 msec in accordance with a time measured by a 20 MHz clock, which is a crystal oscillator clock.

The CPU 961 generates 512 clock pulses of the VCLK (the first clock signal) corresponding to almost one rotation of the photoconductor drum 102 with a fixed spacing therebetween. The number of clock pulses for the VCLK indicates the timing corresponding to a surface position of the photoconductor drum 102 with respect to the HP signal.

The VCLK corresponds to a 1 step position unit in the case where, for example, 16-split linear interpolation is performed on 32 block data in 800 msec corresponding to 1 rotation of a photoconductor drum. When 1 rotation of a photoconductor drum corresponds to 16000000 counts, 1 block corresponds to 500000 counts and 1 VCLK corresponds to 31250 counts. The sub-scanning clock count is increased from 0 to 511 in one rotation of the photoconductor drum and is reset to 0 for every rotation. In addition, the CPU 961 latches a count value in accordance with a BD signal, and thus blocks in the sub-scanning direction are configured not to be subjected to processing in one main scanning period. The latched sub-scanning-direction clock count becomes higher-order bits of a read address of a two-dimensional drum nonuniformity memory (not illustrated) for correcting nonuniformity in the characteristics of sensitivity of the photoconductor drum.

The CPU 961 generates a drum counter clock, which is a periodic signal regarding the main scanning direction illustrated in FIG. 11B (a second clock signal having a predetermined frequency, which is hereinafter referred to as an HCLK). First, the CPU 961 determines a sub-scanning position on a surface of the photoconductor drum 102 from the VCLK, and holds the sub-scanning position so as to be at one position in a one-scan-line period. Then, the CPU 961 resets a main-scanning-direction position counter (a second counter) with reference to the falling edge of a BD signal, and computes pieces of drum SHD data on the surface of the photoconductor drum in a one-scan-line period. The count is increased from 0 to 31 in a one-scan-line period and is reset to 0 for every one-scan-line period.

The CPU 961 generates a polygon-face counter clock, which is a periodic signal regarding polygon rotation illustrated in FIG. 11C (a third clock signal having a predetermined frequency, which is hereinafter referred to as a PCLK).

The CPU 961 determines a scan surface in rotation of the rotating polygon mirror 202 in accordance with a PCLK corresponding to the falling edge of an FG signal and the falling edge of a BD signal. The count is increased from 0 to 4 in one rotation of the rotating polygon mirror 202 and is reset to 0 for every rotation. Then, the CPU 961 holds a piece of surface information for each laser in a one-scan-line period.

In this manner, the CPU 961 determines a sub-scanning correction position of the image forming apparatus 100 in the outside of the laser driver IC 400 in accordance with an SHD sequence.

Figure 12:
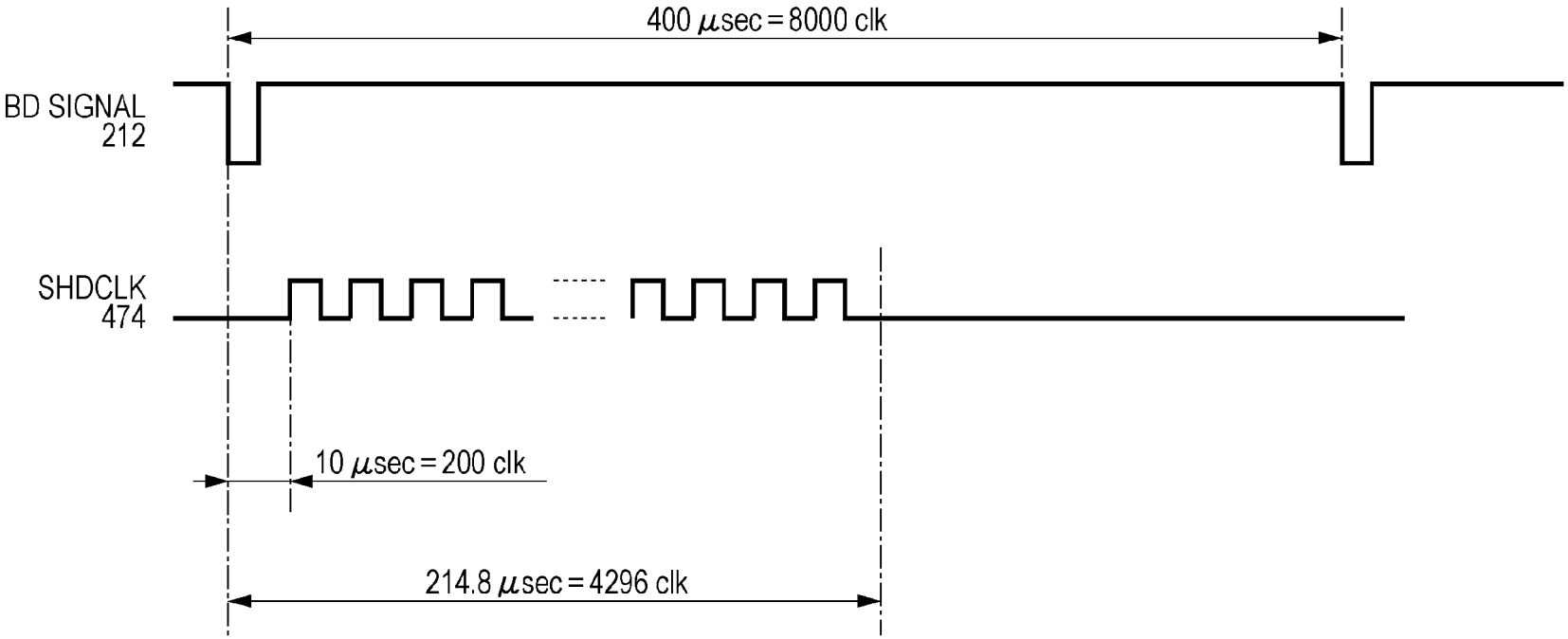
FIG. 12 is a diagram illustrating an example of a shading clock in a one-scan-line period of a plurality of laser beams.

FIG. 12 is a diagram illustrating an example of a shading clock in a one-scan-line period of a plurality of laser beams.

In FIG. 12, the SHDCLK 474 is used as a periodic signal regarding the main scanning direction. The CPU 961 resets a timer counter with reference to the falling edge of a BD signal. Then, from a first predetermined time to a second predetermined time in a one-scan-line period, the CPU 961 generates a clock signal having a period of about, for example, 0.4 μsec in accordance with a time measured by a crystal oscillator clock.

The CPU 961 generates 512 clock pulses corresponding to almost a video region in accordance with a start position and an end position of the SHDCLK 474 and generates 524 clock pulses including 12 adjustment clock pulses with a fixed spacing therebetween. With respect to the BD signal, the number of clock pulses indicates the timing necessary for computation of an SHD correction position in the laser driver IC 400 for SHD correction and for driving the APC light emission DA converters 404A and 404B.

Specifically, a reference BD period has been set to 400 usec in advance, and a reference start time and a reference end time of a video region have been set to 10 usec and 214.8 usec in advance. The reference BD period and the video region times have values as in the following. That is, the values are values used as conditions under which an optical nonuniformity position indicating nonuniformity in the optical characteristics of the optical member and a drum nonuniformity position indicating nonuniformity in the characteristics of sensitivity of the photoconductor drum 102 are reproduced, the optical nonuniformity position and the drum nonuniformity position having been measured in advance using measurement tools during manufacture of the light scan unit 104 and the photoconductor drum 102 in a factory. These values are designed so as to correspond to periods corresponding to data in each memory.

In this manner, a correction position in the main scanning direction is determined through SHD correction performed by the laser driver IC 400.

Next, the CPU 961 transfers, to the FIFO memories 421A and 421B of the laser driver IC 400, correction data of one line for one scan line in units of one scan line as SHD correction data of the outside of the laser driver IC 400.

Figure 13:
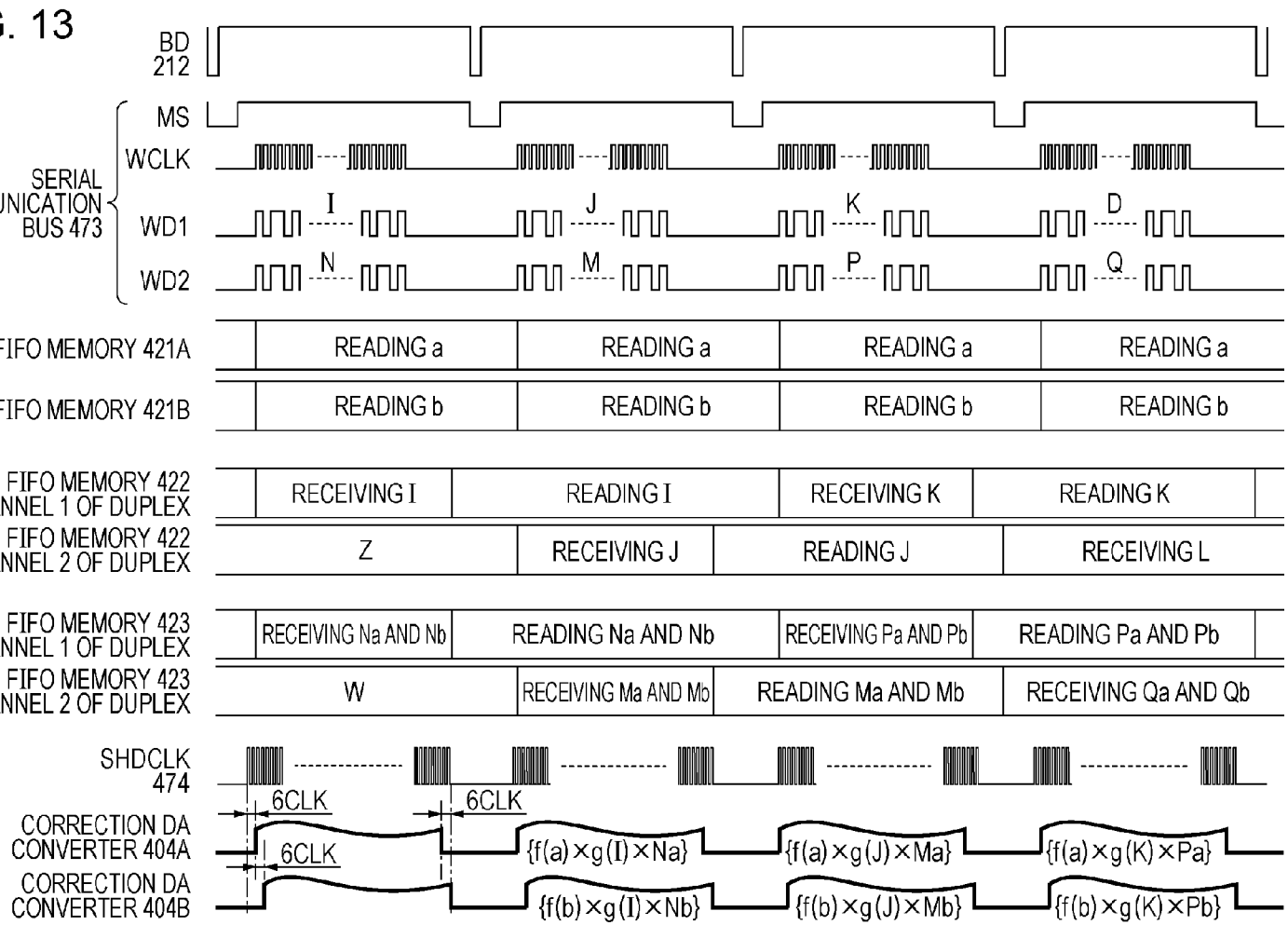
FIG. 13 is a diagram illustrating an example of pieces of correction data and a light intensity correction timing in a one-scan-line period of a plurality of laser beams.

FIG. 13 is a diagram illustrating an example of pieces of correction data and a light intensity correction timing in a one-scan-line period of a plurality of laser beams.

FIG. 13 illustrates a signal for correcting nonuniformity in a correction-data serial communication bus 473, data which is an output from the parallel conversion unit 472, and the timing of each of the FIFO memories 423, 422, 421A, and 421B and a BD signal. FIG. 13 illustrates the case where pieces of drum SHD data Z, I, J, K, and L in units of one scan line and pieces of surface SHD data W, L, M, P, and Q in units of one scan line are alternately stored in a memory.

In addition, as a result of the first preparation operation, pieces of optical SHD data a and b for one scan line have been stored in advance in the FIFO memories 421A and 421B.

Figure 14:
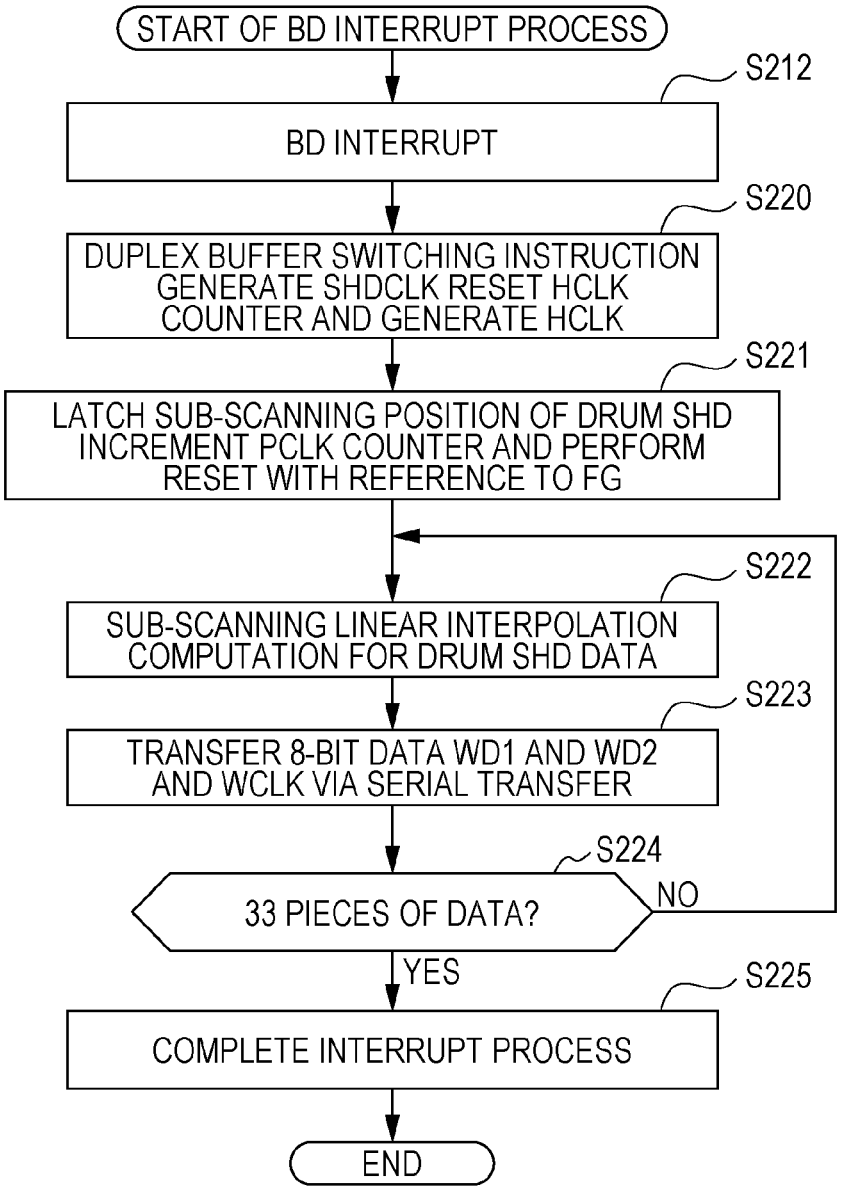
FIG. 14 is a flowchart illustrating an example of a BD interrupt process performed by the CPU of the image forming apparatus.

FIG. 14 is a flowchart illustrating an example of a BD interrupt process performed by the CPU 961 of the image forming apparatus 100.

Unlike transfer of the above-described pieces of optical SHD data a and b, data based on a sub-scanning position and a specific face of the rotating polygon mirror 202 such as the pieces of drum SHD data and the pieces of surface SHD data need to be transferred for every scan line. The FIFO memories 422 and 423 are memories that are alternately used in a full-duplex manner, and store data in the FIFO memories 422 and 423 in advance and function such that the data may be used for correction in the following scan line. In addition, since data transfer for one scan line needs to be completed in a one-scan-line period in advance, data transfer is performed at the timing of a consecutive operation performed by the CPU 961.

In FIG. 14, first, when the CPU 961 receives a BD signal, namely when a BD interrupt occurs (step S212), the CPU 961 outputs a duplex memory (buffer) switching instruction to the laser driver IC 400 and also generates a SHDCLK. Then, the CPU 961 resets an HCLK counter and generates an HCLK (step S220).

Subsequently, the CPU 961 latches a sub-scanning position of drum SHD, and increments a built-in counter for the PCLK and performs a reset with reference to the FG signal (step S221). As described above, first, the CPU 961 determines a sub-scanning position on the surface of the photoconductor drum 102 from a VCLK, and holds the sub-scanning position so as to be at one position in a one-scan-line period. Then, the CPU 961 resets the main-scanning-direction position counter with reference to the falling edge of the BD signal, and computes pieces of drum SHD data on the surface of the photoconductor drum 102 in a one-scan-line period.

In this case, the CPU 961 selects a piece of data closest to four pieces of drum SHD correction data near the position of the surface of the photoconductor drum determined by the VCLK and the HCLK, and acquires a piece of drum SHD correction data (step S222). In parallel with this, for a piece of surface SHD correction data on the rotating polygon mirror 202 determined by the PCLK, the CPU 961 transfers two pieces of correction data to the laser driver IC 400 via serial communication, the two pieces of correction data being data obtained by connecting two pieces of 8-bit data for two lasers, each piece of data being for one laser.

The correction-data serial communication bus 473 used in communication for correcting nonuniformity are constituted by four signal lines including a toggle signal line of a duplex buffer, a clock signal line, and two data lines. Hereinafter data in the toggle signal line, data in the clock signal line, and data in the two data lines are referred to as an MS, a WCLK, a WD1, and a WD2, respectively. As the WD1, pieces of drum SHD correction data having 264 bits in total are transferred to the laser driver IC 400, the 264 bits corresponding to 33 pieces of 8-bit data corresponding to a video region of one scan line for the BD signal.

As the WD2, pieces of surface SHD correction data having 16 bits in total are transferred to the laser driver IC 400, the 16 bits corresponding to 2 pieces of 8-bit data corresponding to 2 lasers for a face of the rotating polygon mirror in one scan line for the BD signal. As the MS and the WCLK, communication control signals common for the WD1 and WD2 are transferred.

The WCLK illustrates the timing necessary for data transfer through a serial data transfer bus, the frequency of which is 8 times higher (8 MHz) than that of the HCLK. The MS occurs so as to correspond to the period of the BD signal. When the falling edge of the BD signal is input to the MS, a state register of the duplex buffer is inverted.

In this manner, the CPU 961 transfers the WD1 and WD2, which are 8-bit data, and the WCLK via serial transfer (step S223). For example, as in FIG. 13, groups of pieces of drum SHD data I, J, K, and L transferred as the WD1 for one scan line are buffered. Likewise, groups of pieces of surface SHD data N, M, P, and Q for two lasers and transferred as the WD2 for one scan line are buffered.

Subsequently, the CPU 961 determines whether or not the above-described 33 pieces of data have been transferred (step S224). In the case where transfer of the 33 pieces of data has not been completed (NO in step S224), the CPU 961 continues transfer. In contrast, in the case where transfer of the 33 pieces of data has been completed (YES in step S224), the CPU 961 completes the BD interrupt process (step S225).

As described above, the CPU 961 performs transfer of pieces of SHD correction data for 33 different HCLKs. The CPU 961 performs data transfer to the laser driver IC 400 via serial communication by performing a computation process in a period of about 1 μsec. The parallel conversion unit 472 performs parallel conversion on 8-bit serial data, and writes the resulting data into the FIFO memories 423 and 422.

Figure 15:
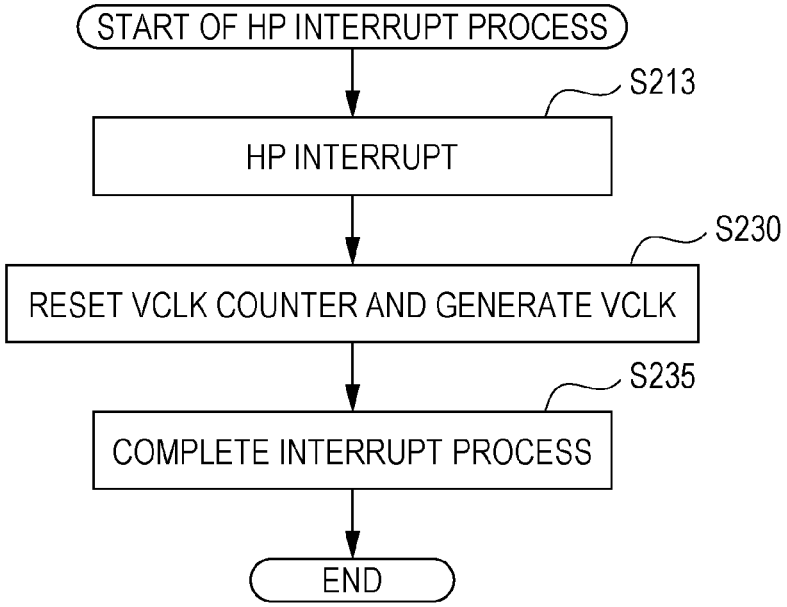
FIG. 15 is a flowchart illustrating an example of an HP interrupt process performed by the CPU of the image forming apparatus.

FIG. 15 is a flowchart illustrating an example of an HP interrupt process performed by the CPU 961 of the image forming apparatus 100.

In FIG. 15, when the CPU 961 receives an HP signal, namely when an HP interrupt occurs (step S213), the CPU 961 resets the VCLK counter and generates a VCLK (step S230). Then, the CPU 961 completes the HP interruption process (step S235).

Next, data computation at a correction position in the laser driver IC 400 will be explained.

In the laser driver IC 400, regarding the semiconductor laser 302A, a piece of first data is read from the FIFO memory 423 and also pieces of data are read from the FIFO memories 422 and 421A in accordance with the timing of the SHDCLK 474. All the pieces of read data are treated as pieces of 8-bit 256-levels-of-gray data in the following computation. For example, the groups of pieces of drum SHD data I, J, K, and L transferred as the WD1 for one scan line as in FIG. 13 are delayed by one scan line using a buffer and read. Likewise, the groups of pieces of surface SHD data N, M, P, and Q for two lasers and transferred as the WD2 for one scan line are delayed by one scan line using a buffer and read.

Each of the proximity selecting units 426 and 425A, which select pieces of closest data, selects pieces of proximity data from among pieces of data in the FIFO memory 422 and pieces of data in the FIFO memory 421A. First, the proximity selecting unit 426 selectively reads two pieces of data that sandwich the current position from 33 pieces of data for 32 blocks from the FIFO memory 422. Sixteen SHDCLKs correspond to one block, and the proximity selecting unit 426 determines, during 16 CLKs, pieces of proximity data in accordance with a distance relationship among pieces of original data. For example, pieces of data obtained by performing a drum SHD proximity selection process on pieces of data I for one scan line are denoted by g(I).

In contrast, the proximity selecting unit 425A selectively reads two pieces of data that sandwich the current position from 17 pieces of data for 16 blocks from the FIFO memory 421A. Thirty-two SHDCLKs correspond to one block, and the proximity selecting unit 425A determines, during 32 CLKs, pieces of proximity data in accordance with a distance relationship among pieces of original data. For example, an optical SHD proximity selection process for pieces of data a for one scan line of one laser is denoted as a function f(a). An output from the proximity selecting unit 426 and an output from the proximity selecting unit 425A are supplied to the multiplying unit 424A, and multiplication is performed here.

Pieces of surface SHD data in the FIFO memory 423 are constituted by elements for lasers. For example, elements of the group of pieces of surface SHD data N for one scan surface are denoted by Na and Nb, which include pieces of correspondence data a and b of the semiconductor lasers 302A and 302B, respectively.

An output from the multiplying unit 424A and an output (data) from the FIFO memory 423 are supplied to the multiplying unit 427A, and multiplication is performed here. A piece of correction data is output from the multiplying unit 427A. Then, the light-reducing computation unit 410A calculates a light reduction amount in accordance with the piece of correction data. This computation is performed for 512 SHDCLKs, which are 512 correction position timings. The data obtained from a read process from the FIFO memory 423 and a computation process performed by the proximity selecting units are subjected to pipeline processing for a time period of six clock pulses of the SHDCLK, and the resulting data is sent to the light-reducing computation unit 410A.

Here, the light-reducing computation unit 410A functions such that after the first piece of data is taken out from a correction profile at the start of the SHDCLK at the beginning and computation is performed, the value of APC light emission DA converter 404A is changed after six clock pulses and the light intensity of the semiconductor laser 302A is corrected. Thus, an SHDCLK is generated six clock pulses before a predetermined SHD position in the main scanning direction.

About the semiconductor laser 302B, a piece of second data in the FIFO memory 423 and pieces of data in the FIFO memories 422 and 421B are used. Then, in the proximity selecting units 426 and 425B and the light-reducing computation unit 410B, processing similar to that in the case of the semiconductor laser 302A is performed.

As explained in association with FIG. 7, since laser light from the semiconductor laser 302B is delayed by 42.3 μm and scans a scan surface next to laser light from the semiconductor laser 302A, a correction timing is delayed in accordance with the delay. Since the amount of delay corresponds to six clock pulses, the APC light emission DA converter 404B starts its operation after six clock pulses from the start of a video region.

Laser light from the semiconductor laser 302B also performs SHD correction in the video region, similarly to laser light from the semiconductor laser 302A. Six clock pulses are added to the end and the number of clock pulses for the SHDCLK after adjustment is designed such that six clock pulses are added to both before and after a predetermined laser scan light intensity correction timing.

Note that laser electric current modulation performed by the PWMIC 905 is subjected to parallel processing in the APC light emission DA converters 404A and 404B and a correction operation is performed.

For example, as in FIG. 13, the group of pieces of drum SHD data I transferred as the WD1 for one scan line, the group of pieces of surface SHD data N for two lasers and transferred as the WD2 for one scan line are delayed by one scan line using a buffer and read.

Correction $DA$ Value $404A=\{f(a)\times g(I)\times Na\}$

Correction $DA$ Value $404B=\{f(b)\times g(I)\times Nb\}$

Thus, pieces of analog data based on laser electric current modulation are obtained.

The vertical axis of FIG. 13 for waveforms for correction DA converters (the APC light emission DA converters 404A and 404B) illustrates an example of an image of analog values. The rising edge and the falling edge of an analog value for a correction DA converter (the APC light emission DA converter 404A) of the semiconductor laser 302A for each scan line correspond to the timing that is 6 CLKs after the start of the SHDCLK and the timing that is 6 CLKs before the end of the SHDCLK. The rising edge and the falling edge of an analog value from a correction DA converter (the APC light emission DA converter 404B) of the semiconductor laser 302B for each scan line correspond to the timing that is 12 CLKs after the start of the SHDCLK and the timing that is the end of the SHDCLK.

In this manner, in the first embodiment, SHD correction is made valid at a position corresponding to the SHDCLK in the video region with reference to an APC light intensity, and laser light intensity correction data prepared in advance through SHD transfer is made valid at a position corresponding to the SHDCLK. As a result, an image exposure region may be exposed to light at an appropriate light intensity obtained by performing correction on the entire nonuniformity.

Figure 17:
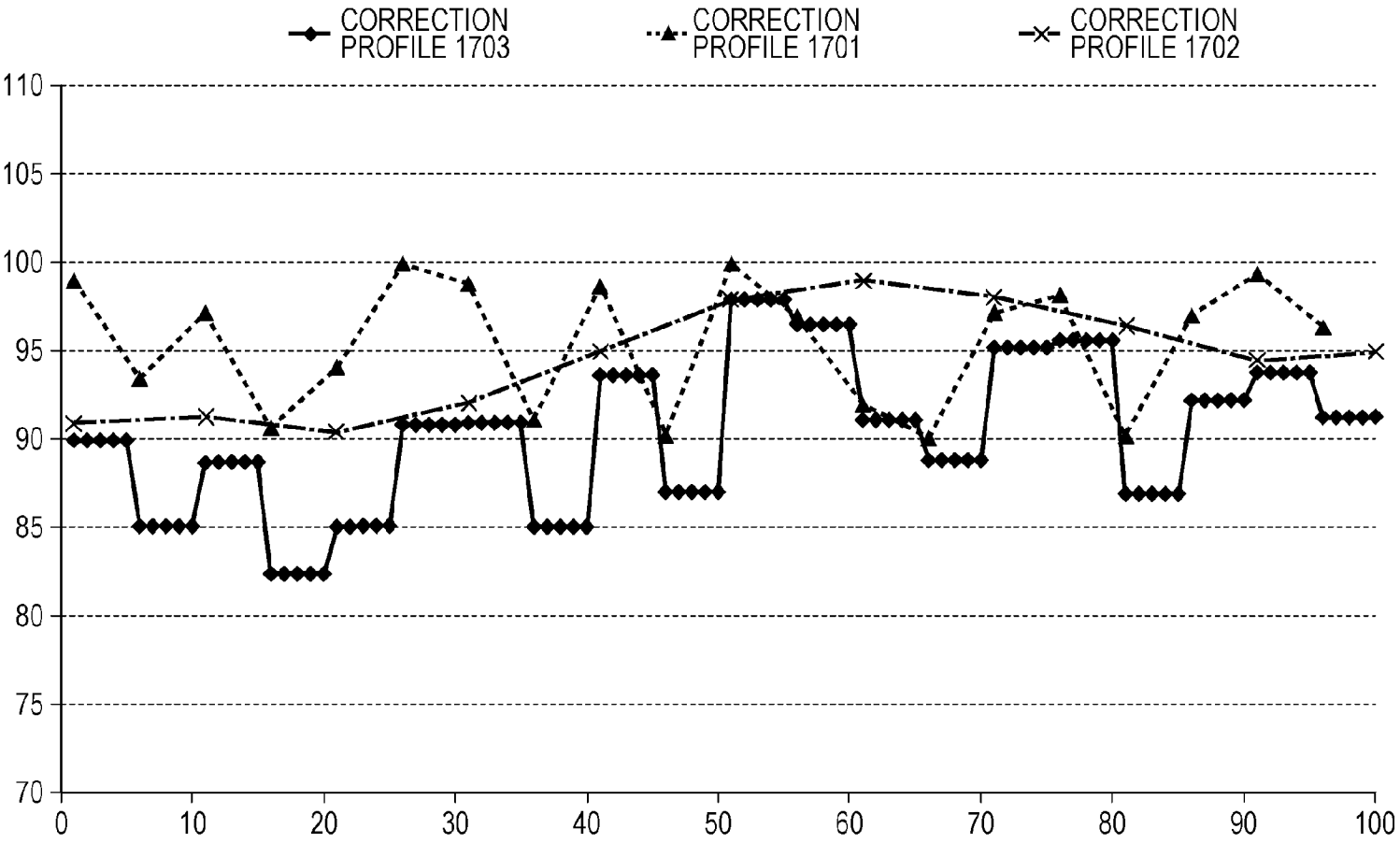
FIG. 17 is a diagram illustrating an example of correction profiles of the first embodiment.

FIG. 17 is a diagram illustrating an example of correction profiles of the first embodiment.

Figure 16:
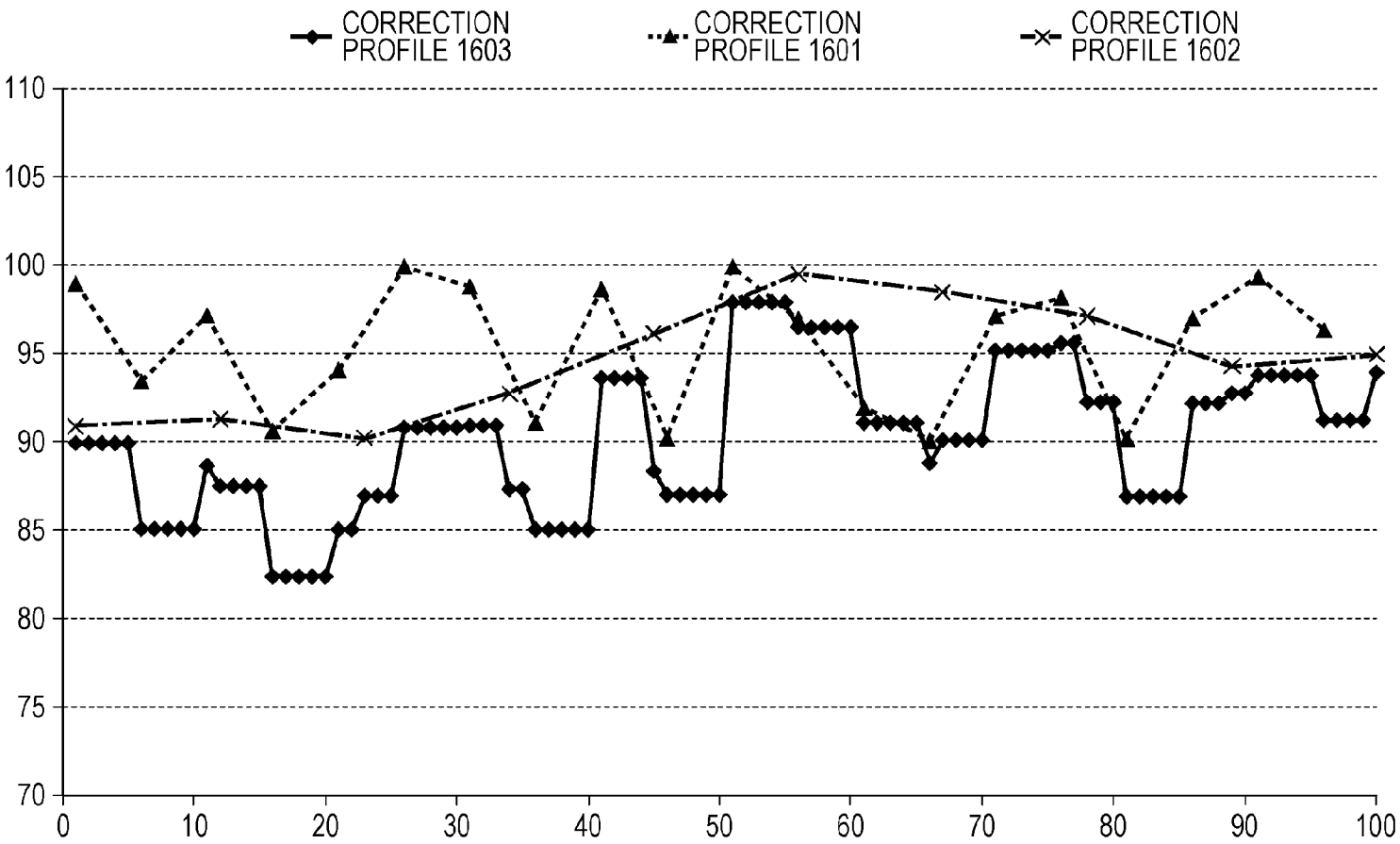
FIG. 16 is a diagram illustrating an example of correction profiles of a conventional example.

FIG. 17 illustrates an example of a relationship between correction profiles, one of the correction profiles having been obtained by multiplying a correction amount for correcting nonuniformity in the characteristics of sensitivity of the photoconductor drum 102 and a correction amount for correcting the optical characteristics of the optical member, by making a comparison with a known technology illustrated in FIG. 16. The horizontal axis of FIG. 17 represents a scan position in the direction of the length (the main scanning direction) of the photoconductor drum 102 in millimeters, and the vertical axis of FIG. 17 represents a correction amount in percentage in the case where the maximum drum-surface light intensity before light intensity adjustment corresponds to 100%.

A correction profile 1701, a correction profile 1702, and a correction profile 1703 correspond to g(I), f(a), and {f(a)×g(I)}, respectively.

For correction of nonuniformity in the characteristics of sensitivity of the photoconductor drum 102, for example, correction is needed with a spatial frequency having a period of about 12 mm as a drum-surface distance and with a high resolution greater than or equal to 8 bits (256 levels of gray). Furthermore, for correction of the optical characteristics of the optical member, for example, correction is needed with a spatial frequency having a period of about 26 mm as a drum-surface distance and with a high resolution greater than or equal to 8 bits (256 levels of gray). On the basis of a spatial frequency of 12 mm for correcting nonuniformity in the characteristics of sensitivity of the photoconductor drum 102, pieces of correction data are provided with which the optical characteristics of the optical member are corrected at a spatial frequency of 24 mm, which is an integral multiple of 12 mm.

In light intensity control when a laser is on, the APC light emission DA converter 404A inside the laser driver IC 400 is driven and a driving current of the semiconductor laser 302A is modulated in accordance with a value obtained by multiplying the correction profile 1703 by an optical face tangle error correction amount Na. As a result, the nonuniformity in the characteristics of sensitivity of a photoconductor drum and the nonuniformity in the optical characteristics of an optical member are reduced.

Even when the total number of points in a profile reaches a maximum, the APC light emission DA converter 404A is driven at the frequency that is the slower one (24 mm) of the spatial frequencies.

For example, the current value corresponds to 88.5% at a position of 11 mm in FIG. 17, and the current value is maintained at 88.5% at a position of from 12 mm to 15 mm. Multiplication in which the correction profile 1703 is obtained by multiplying the correction profile 1701 by the correction profile 1702 is necessary at a period of 6 μsec. A scan position travel distance of 6 mm corresponds to 6 μsec. Here, since a circuit that modulates the amount of a laser current responds to the correction profile 1703, an computing circuit operation performed at a certain speed with a certain accuracy and an analog operation are implemented, the certain speed and accuracy being 166 kHz, 1 mW or higher, and a resolution of 8 bits.

In a conventional example, for nonuniformity in the optical characteristics of the optical member and nonuniformity in the characteristics of sensitivity of the photoconductor drum 102, 10 pieces of correction data and 20 pieces of correction data are present in the periods of 13 μsec and 6 μsec, for a 100-mm scan, respectively. Since the cases where pieces of data are close to each other by coincidence are included, when the APC light emission DA converter 404A, which is driven at a fixed interval at all the correction data positions, is driven in an analog manner, the APC light emission DA converter 404A needs to be operated 100 times in a period corresponding to a 100-mm scan.

In the first embodiment, for nonuniformity in the optical characteristics of the optical member and nonuniformity in the characteristics of sensitivity of the photoconductor drum 102, 11 pieces of correction data and 20 pieces of correction data are present in the periods of 12 μsec and 6 μsec, for a 100-mm scan, respectively. Even when the APC light emission DA converter 404A, which is driven at a fixed interval at all the correction data positions, is driven in an analog manner, the APC light emission DA converter 404A has only to be operated 20 times in a period corresponding to a 100-mm scan and the cumulative power consumption necessary for one scan is reduced to one fifth.

It is necessary to bring forward the timing of start of correction toward that of the BD 212 using the SHDCLK by a period corresponding to a delay in response of the APC light emission DA converter 404A; however, the maximum frequency performance required for changing digital input data is one sixth less than that in the conventional example.

In addition, power is proportional to the number of beams as the number of DA circuits (the APC light emission DA converters 404A and 404B), and thus power for differential circuits necessary for an analog operation is reduced and heat generation is relatively low. Again, a driving circuit including the configuration of a heat-dissipating component, the configuration of a power-source stabilizing circuit, and the like may be significantly reduced in size, and as a result a reduction in cost may be realized.

In an example of the first embodiment, in order to correct nonuniformity having a period of 26 mm or longer as a drum-surface distance, there is provided pieces of correction data for correcting the optical characteristics of the optical member having a period of 24 mm, which is less than 26 mm. In this manner, in the first embodiment, since adjustment is performed using the higher one of spatial frequencies, the ability to adjust a plurality of requests for correcting nonuniformity is not reduced in the first embodiment.

According to the first embodiment as descried above, when correction of an image formation position is controlled, a frequency for a digital computation circuit operation and a frequency for an analog operation are limited to frequencies as low as possible. As a result, low heat generation may be maintained and an increase in cost caused when the size of a driving circuit is increased may be prevented, the driving circuit including a heat-dissipating component, a power-source stabilizing circuit, and the like. As a result, an image forming apparatus may be provided that is superior in cost and processing performance.

Second Embodiment

Figure 18:
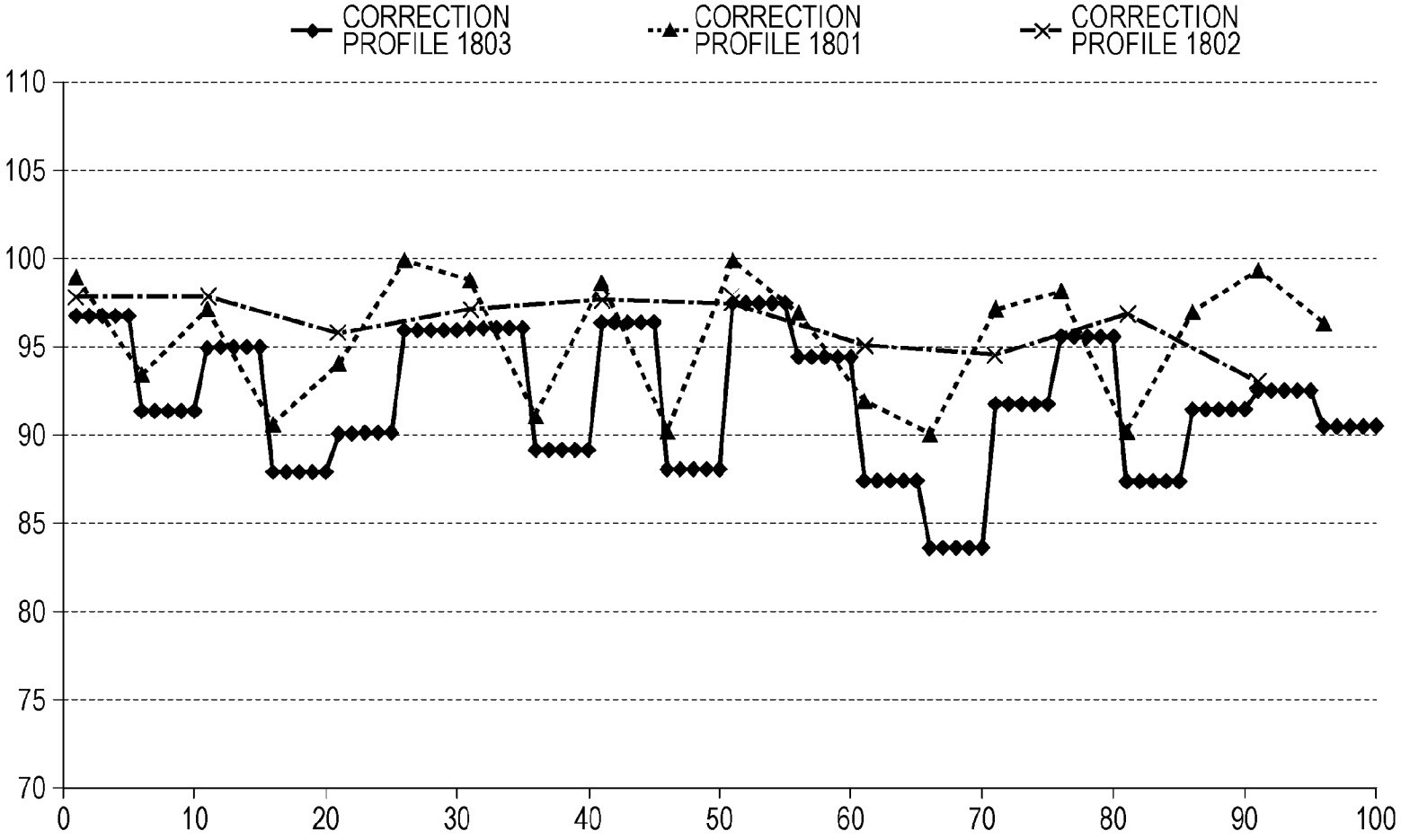
FIG. 18 is a diagram illustrating an example of correction profiles of the second embodiment.

A second embodiment differs from the first embodiment in terms of points explained in FIG. 18. The other elements of the second embodiment are the same as those in the first embodiment (FIGS. 1 to 6B and FIG. 9), and thus an explanation thereof will be omitted.

In the first embodiment, optical face tangle error correction in which a correction amount is fixed within each face of the rotating polygon mirror 202 (within each polygon face) has been explained as an example. In contrast to this, in the second embodiment, an optical face tangle error nonuniformity correction profile is combined, the distribution of each of which is an in-plane distribution in a laser scan area as in correction of the optical characteristics of the optical member. As a result, a configuration similar to the configuration of the shading circuit for correcting the optical characteristics of the optical member of the first embodiment may be used.

FIG. 18 is a diagram illustrating an example of correction profiles of the second embodiment.

FIG. 18 illustrates an example of a relationship regarding a one-line-scan correction profile obtained by multiplying a correction amount for correcting nonuniformity in the characteristics of sensitivity of the photoconductor drum 102 and a correction amount for correcting optical face tangle error nonuniformity having an in-plane distribution. A correction profile 1801, a correction profile 1802, and a correction profile 1803 correspond to g(I), Na, and {Na×g(I)}, respectively.

In an example of the second embodiment, in order to correct nonuniformity, which has a period of 30 mm or longer as a drum-surface distance, in optical face tangle error, the distribution of which is an in-plane distribution, there is provided pieces of correction data for correcting nonuniformity, which has a period of 24 mm, in optical face tangle error for each face, 24 mm being less than 30 mm. In this manner, in the second embodiment, since adjustment is performed using the higher one of spatial frequencies, the ability to adjust a plurality of requests for correcting nonuniformity is not reduced in the second embodiment.

According to the second embodiment as described above, similarly to as in the first embodiment, when correction of an image formation position is controlled, low heat generation may be maintained and an increase in cost caused when the size of a driving circuit is increased may be prevented, the driving circuit including a heat-dissipating component, a power-source stabilizing circuit, and the like. As a result, an image forming apparatus may be provided that is superior in cost and processing performance.

Other Embodiments

Correction of nonuniformity in the characteristics of sensitivity of the photoconductor drum 102, correction of the optical characteristics of the optical member, and superimposition and correction of an optical face tangle error of the rotating polygon mirror 202 have been described as an example in the first embodiment; however, examples are not limited to this example. Embodiments may also be realized by using four or more dimensional nonuniformity profiles that are combined, examples of the dimensional nonuniformity profiles being regarding other types of nonuniformity corresponding to the laser scan area (nonuniformity regarding the intermediate transfer belt, nonuniformity in vibration of an image driving unit, and nonuniformity in the developing high voltage period). In addition, the present embodiments may also be applied to correction of nonuniformity, which is obtained by two or more types of nonuniformity arbitrarily selected from among the above-described plurality of types of nonuniformity.

For example, the light intensity of laser light emitted from the semiconductor laser 302 is modulated and controlled in accordance with the pieces of first and second correction data explained in the first embodiment and pieces of third correction data described in the following. Then, nonuniformity in electric potential characteristics, nonuniformity in optical characteristics, and nonuniformity in each face of the rotating polygon mirror 202 may also be corrected. The pieces of third correction data has a distribution in each face of the rotating polygon mirror 202 and also has a lower density than the pieces of first correction data. The pieces of third correction data are pieces of surface nonuniformity correction data for surfaces constituted by combinations of a plurality of third regions and the faces of the rotating polygon mirror 202, the plurality of third regions being constituted by a portion of a plurality of first regions on the surface of the photoconductor drum 102. The pieces of third correction data are stored in the surface SHD EEPROM 402.

The example in which the period of nonuniformity in the characteristics of sensitivity of the photoconductor drum 102 (12 mm) is shorter than the period of nonuniformity in the optical characteristics of the optical member (26 mm) has been explained in the first embodiment; however examples are not limited to this example. Embodiments may also be realized by using a combination of the case where a period that changes in accordance with characteristics of each apparatus and a combination of the case where there is an inverse relationship between lengths.

In the case where the present inventions are applied to a combination of a plurality of nonuniformity, a profile has only to be measured, for the longer one of the correction operation periods, at positions that are integral multiples of the shorter one of the correction operation periods, and a laser electric current modulation circuit has only to be driven in the shorter one of the correction operation periods. As a result, a low-cost circuit is obtained that is constituted to achieve minimum heat generation with a minimum operation frequency appropriate to a frequency used for a correction request.

In the first embodiment, exposure positions, electric current modulation positions, and timing have been defined using, as a unit, the correction operation period of an analog circuit or an electric current driving circuit; however, examples are not limited to this first embodiment. A profile of a plurality of nonuniformity correction factors to be a correction target may also be selected from among profiles having periods that are integral multiples of this correction operation period.

For example, the present embodiments may be applicable using a combination with a correction operation based on linear interpolation, which is a conventional technology, it is desirable that a profile of a plurality of nonuniformity correction factors be formed using a ratio that is an integral multiple of the correction operation period of an electric current driving circuit serving as a unit. In other words, using a ratio that is an integral multiple, the timing of superimposition and correction of nonuniformity of a plurality of factors is aligned and also the correction operation period of an electric current driving circuit is maintained to an appropriate low frequency. Furthermore, the frequency of linear interpolation computation may also be maintained to an appropriate low frequency.

An example of a two-laser VCSEL has been explained in the first and second embodiments; however, examples are not limited to this example. Even in the case of edge emitting lasers other than VCSELs, the present embodiment may be applicable either using one laser or two or more lasers. Since a low heat generation effect is proportional to the size of a circuit, the more the number of lasers, the greater the cost reducing effect.

In the first and second embodiments, the configuration is described in which the EEPROM used to store a profile used to correct the optical characteristics of an optical member is provided inside the laser driver IC 400; however, configurations are not limited to this configuration. By using the assembling unit of an optical scanner and treating a maintenance replacement component as a unit, when a configuration is used in which an EEPROM is mounted in parallel with the same component unit or a circuit board unit, the EEPROM may also be provided outside the laser driver IC 400.

In the first and second embodiments, the configuration is described in which the EEPROM used to store a profile used to correct the optical face tangle error nonuniformity of the rotating polygon mirror 202 is provided inside the polygon motor 203; however, configurations are not limited to this configuration. By using the assembling unit of an optical scanner and treating a maintenance replacement component as a unit, when a configuration is used in which an EEPROM is mounted in parallel with the same component unit or an optical scanning unit, the EEPROM may also be provided outside the polygon motor 203. In addition, an EEPROM may also be used for both the profile used to correct the optical characteristics of an optical member and for the profile used to correct the optical face tangle error nonuniformity of the rotating polygon mirror 202.

In the first and second embodiments, a color image forming apparatus and an optical scanner provided in the color image forming apparatus have been explained as an example; however, examples are not limited to this example. An image forming apparatus that forms images in monochrome and an optical scanner provided in the image forming apparatus may also be used.

For example, functions of the above-described embodiments are treated as a control method, and this control method has only to be executed by an optical scanner and a controller arranged outside the optical scanner. In addition, a program having the functions of the above-described embodiments is treated as a control program, and the control program has only to be executed by an optical scanner and a computer equipped with a controller arranged outside the optical scanner. Note that the control program is, for example, recorded in a computer readable recording medium.

In addition, the present inventions may also be realized by executing the following process. That is, the process is a process in which a software product (program) that realizes the functions of the above-described embodiments is supplied to a system or an apparatus via a network or various types of recording mediums, and a computer (alternatively, a CPU, an MPU, or the like) of the system or the apparatus reads and executes the program.

According to the embodiments of the present inventions, a working speed of a unit used to generate pieces of correction data with which the light intensity of a light beam may be prevented from being increased.

While the present inventions have been described with reference to exemplary embodiments, it is to be understood that the inventions are not limited to the disclosed exemplary embodiments. The scope of the following claims is to be accorded the broadest interpretation so as to encompass all such modifications and equivalent structures and functions.

This application claims the benefit of Japanese Patent Application No. 2014-056228, filed Mar. 19, 2014, which is hereby incorporated by reference herein in its entirety.

What is claimed is:

1. An image forming apparatus, the image forming apparatus including a light source configured to emit a light beam, a photoconductor configured to be exposed to the light beam emitted from the light source, a deflection unit configured to deflect the light beam such that the light beam scans the photoconductor, and an optical member configured to guide the light beam deflected by the deflection unit to the photoconductor, the image forming apparatus developing, using toner, an electrostatic latent image formed on the photoconductor by exposure to the light beam, the image forming apparatus comprising:

a storage unit configured to store a plurality of pieces of first correction data and a plurality of pieces of second correction data, the plurality of pieces of first correction data being pieces of data for correcting nonuniformity in density of a toner image, the nonuniformity being caused by electric potential characteristics of the photoconductor with respect to a light beam in a scanning direction in which the light beam scans the photoconductor, the plurality of pieces of first correction data being pieces of data corresponding to respective scan positions of the light beam in the scanning direction, the plurality of pieces of second correction data being pieces of data for correcting a change in light intensity of the light beam guided onto the photoconductor, the change being caused by optical characteristics of the optical member in the scanning direction, the plurality of pieces of second correction data also being pieces of data corresponding to the respective scan positions of the light beam in the scanning direction; and a control unit configured to control, in accordance with a piece of first correction data among the plurality of pieces of first correction data and a piece of second correction data among the plurality of pieces of second correction data output from the storage unit, light intensity of the light beam corresponding to a scan position of the light beam in the scanning direction, wherein in a period in which the light beam scans once across the photoconductor, timing of a piece of first correction data output by the storage unit from the plurality of pieces of first correction data matches, at least once, timing of a piece of second correction data output by the storage unit from the plurality of pieces of second correction data, and a period in which the storage unit outputs a piece of first correction data from the plurality of pieces of first correction data and a period in which the storage unit outputs a piece of second correction data from the plurality of pieces of second correction data have an integral multiple relationship.

2. The image forming apparatus according to claim 1, wherein the period in which the storage unit outputs a piece of second correction data from the plurality of pieces of second correction data is an integral multiple of the period in which the storage unit outputs a piece of first correction data from the plurality of pieces of first correction data.

3. The image forming apparatus according to claim 2, wherein the period in which the storage unit outputs a piece of second correction data from the plurality of pieces of second correction data is twice as long as the period in which the storage unit outputs a piece of first correction data from the plurality of pieces of first correction data.

4. The image forming apparatus according to claim 1, wherein the period in which the storage unit outputs a piece of second correction data from the plurality of pieces of second correction data is the same as the period in which the storage unit outputs a piece of first correction data from the plurality of pieces of first correction data.

5. The image forming apparatus according to claim 1, further comprising:

a signal generation unit configured to generate a clock signal, wherein the storage unit outputs, in synchronization with the clock signal, a piece of first correction data from the plurality of pieces of first correction data and a piece of second correction data from the plurality of pieces of second correction data in accordance with a scan position of the light beam, and the control unit generates, in accordance with the piece of first correction data and the piece of second correction data output from the storage unit, a piece of third correction data through computation in synchronization with the clock signal, the piece of third correction data being a piece of data for controlling the light intensity of the light beam.

6. The image forming apparatus according to claim 5, wherein for positions each of which is between adjacent scan positions among the plurality of scan positions, the control unit generates, for each of the positions, a piece of first interpolated data in accordance with pieces of first correction data corresponding to adjacent scan positions corresponding to the position and a piece of second interpolated data in accordance with pieces of second correction data corresponding to the adjacent scan positions, and generates a piece of third correction data through computation in accordance with the piece of first interpolated data and the piece of second interpolated data.

7. A correction data generation method for controlling light intensity of a light beam in an image forming apparatus in which the light beam is deflected by a deflection unit of the image forming apparatus such that the light beam, which is emitted from a light source of the image forming apparatus, scans a photoconductor of the image forming apparatus and the light beam deflected by the deflection unit is guided onto the photoconductor by an optical member of the image forming apparatus, the correction data generation method comprising:

first outputting, by a storage unit of the image forming apparatus in accordance with a plurality of scan positions of the light beam, a plurality of pieces of first correction data for correcting nonuniformity in density of a toner image, the nonuniformity being caused by electric potential characteristics of the photoconductor with respect to a light beam in a scanning direction in which the light beam scans the photoconductor, the plurality of pieces of first correction data being pieces of data corresponding to the respective scan positions of the light beam in the scanning direction;

second outputting, in accordance with the plurality of scan positions of the light beam, a plurality of pieces of second correction data for correcting a change in light intensity of the light beam guided onto the photoconductor, the change being caused by optical characteristics of the optical member in the scanning direction, the plurality of pieces of second correction data being pieces of data corresponding to the respective scan positions of the light beam in the scanning direction; and generating pieces of third correction data corresponding to the plurality of scan positions in accordance with the plurality of pieces of first correction data output in the first outputting step and the plurality of pieces of second correction data output in the second outputting step, the generating step being executed by a control unit of the image forming apparatus, wherein in a period in which the light beam scans once across the photoconductor, timing of the first outputting step executed by the storage unit matches, at least once, timing of the second outputting step executed by the storage unit, and a period in which the first outputting step is executed by the storage unit and a period in which the second outputting step is executed by the storage unit have an integral multiple relationship.

8. The correction data generation method according to claim 7, wherein the period in which the second outputting step is executed by the storage unit is an integral multiple of the period in which the first outputting step is executed by the storage unit.

9. The correction data generation method according to claim 8, wherein the period in which the second outputting step is executed by the storage unit is twice as long as the period in which the first outputting step is executed by the storage unit.

10. The correction data generation method according to claim 7, wherein the period in which the first outputting step is executed by the storage unit is the same as the period in which the second outputting step is executed by the storage unit.

11. The correction data generation method according to claim 7, wherein the first outputting step and the second outputting step are executed by the storage unit in synchronization with a clock signal output from a signal generation unit of the image forming apparatus, and the generating step includes computing in which the pieces of third correction data for controlling the light intensity of the light beam are computed by the control unit in synchronization with the clock signal and in accordance with the plurality of pieces of first correction data and the plurality of pieces of second correction data.

12. The correction data generation method according to claim 11, wherein the generating step further includes for positions each of which is between adjacent scan positions among the plurality of scan positions, generating, for each of the positions, a piece of first interpolated data in accordance with pieces of first correction data corresponding to adjacent scan positions corresponding to the position, the generating step for generating the piece of first interpolated data being executed by the control unit, and for positions each of which is between adjacent scan positions among the plurality of scan positions, generating, for each of the positions, a piece of second interpolated data in accordance with pieces of second correction data corresponding to adjacent scan positions corresponding to the position, the generating step for generating the piece of second interpolated data being executed by the control unit, wherein the computing includes computing in which a piece of third correction data among the pieces of third correction data is computed by the control unit in accordance with the piece of first interpolated data and the piece of second interpolated data.

* * * * *